US011551514B2

(12) United States Patent
Indrakumar

(10) Patent No.: US 11,551,514 B2
(45) Date of Patent: Jan. 10, 2023

(54) THREE-DIMENSIONAL OBJECTS IN WAGERING GAMES

(71) Applicant: Kuppam Indrakumar, Las Vegas, NV (US)

(72) Inventor: Kuppam Indrakumar, Las Vegas, NV (US)

( * ) Notice: Subject to any disclaimer, the term of this patent is extended or adjusted under 35 U.S.C. 154(b) by 0 days.

(21) Appl. No.: 17/508,134

(22) Filed: Oct. 22, 2021

(65) Prior Publication Data

US 2022/0270437 A1 Aug. 25, 2022

Related U.S. Application Data

(60) Provisional application No. 63/151,669, filed on Feb. 20, 2021.

(51) Int. Cl.
*G07F 17/00* (2006.01)
*G07F 19/00* (2006.01)
*G07F 17/32* (2006.01)

(52) U.S. Cl.
CPC ..... *G07F 17/3213* (2013.01); *G07F 17/3258* (2013.01); *G07F 17/3267* (2013.01); *G07F 17/3265* (2013.01)

(58) Field of Classification Search
CPC .. G07F 17/32; G07F 17/3211; G07F 17/3213; G07F 17/3244; G07F 17/3258; G07F 17/3265; G07F 17/3267; G07F 17/34
See application file for complete search history.

(56) References Cited

U.S. PATENT DOCUMENTS 6,120,377 A * 9/2000 McGinnis, Sr. ..... G07F 17/34 463/20
6,123,333 A * 9/2000 McGinnis, Sr. .... G07F 17/3244 273/146
6,241,607 B1 * 6/2001 Payne ..... G07F 17/34 463/20

(Continued)

OTHER PUBLICATIONS

International Search Report and Written Opinion issued in International Application No. PCT/US2022/017029, dated May 13, 2022.

*Primary Examiner* — Milap Shah
(74) *Attorney, Agent, or Firm* — Morris, Manning & Martin, LLP; Adam J. Thompson, Esq.

(57) ABSTRACT

A wagering game system can include a memory and a computing device in communication with the memory. The computing device can generate a representation of prismatic objects, each comprising at least four sides. The computing device can determine sets of indicia from a plurality of indicia, the sets of indicia individually corresponding to a respective prismatic object. The computing device can generate a user interface comprising the representation the prismatic objects arranged in a grid, each side for each prismatic object comprising indicia from a corresponding one of the sets of indicia. The computing device can rotate the representation. The computing device can stop rotation of the representation with a respective randomly selected side being shown on the user interface for each prismatic object. The computing device can determine a wagering game outcome based on the respective randomly selected side being shown on the user interface for each prismatic object.

20 Claims, 11 Drawing Sheets

(56) References Cited

U.S. PATENT DOCUMENTS 6,746,329 B1 * 6/2004 Duhamel ..... G07F 17/3211 273/138.2
7,331,858 B2 * 2/2008 McComb ..... G07F 17/3213 463/16
7,850,520 B2 * 12/2010 Yoshimi ..... G07F 17/34 463/19
7,862,422 B2 1/2011 Garamendi et al.
8,133,111 B2 * 3/2012 Thomas ..... G07F 17/3211 463/20
8,979,634 B2 * 3/2015 Pacey ..... G07F 17/3211 463/31
9,070,259 B2 * 6/2015 Berman ..... G07F 17/34
9,189,926 B2 * 11/2015 Hallerbach ..... G07F 17/34
10,445,976 B2 10/2019 Berman et al.
10,607,448 B2 * 3/2020 Nicely ..... G07F 17/3267
2001/0016513 A1 * 8/2001 Muir ..... G07F 17/34 463/16
2002/0094857 A1 * 7/2002 Meyer ..... G07F 17/34 463/16
2003/0064790 A1 * 4/2003 Hughs-Baird ..... G07F 17/3211 463/20
2004/0009803 A1 * 1/2004 Bennett ..... G07F 17/34 463/16
2004/0043812 A1 * 3/2004 Ellis ..... G07F 17/3211 463/20
2005/0070354 A1 * 3/2005 Baerlocher ..... G07F 17/34 463/20
2006/0009277 A1 1/2006 Hartl et al.
2008/0032774 A1 * 2/2008 Yoshizawa ..... G07F 17/3213 463/16
2008/0032775 A1 * 2/2008 Yoshizawa ..... G07F 17/3211 463/20
2008/0045313 A1 * 2/2008 Yoshizawa ..... G07F 17/32 463/20
2008/0076576 A1 * 3/2008 Graham ..... G07F 17/3272 463/42
2008/0161081 A1 7/2008 Berman
2008/0234032 A1 * 9/2008 Brunet de Courssou ..... G07F 17/3209 463/20
2009/0227357 A1 * 9/2009 Rasmussen ..... G07F 17/32 463/21
2011/0118013 A1 5/2011 Mattice et al.
2012/0115606 A1 5/2012 Seelig
2013/0150142 A1 * 6/2013 Caputo ..... G07F 17/3213 463/20
2013/0190065 A1 * 7/2013 Saunders ..... G07F 17/3213 463/20
2014/0187309 A1 * 7/2014 Trainor ..... G07F 17/326 463/20
2014/0335940 A1 11/2014 Leger et al.
2015/0248808 A1 9/2015 Crawford, III
2018/0025587 A1 * 1/2018 Waters ..... G07F 17/3258 463/19

* cited by examiner

THREE-DIMENSIONAL OBJECTS IN WAGERING GAMES

CROSS-REFERENCE TO RELATED APPLICATIONS

This application claims benefit of, and priority to, U.S. Provisional Application No. 63/151,669, filed Feb. 20, 2021, and entitled "3D SLOT GAMES," the disclosure of which is hereby incorporated by reference in its entirety.

TECHNICAL FIELD

The present systems and processes relate generally to configuring, rendering, and utilizing wagering games.

BACKGROUND

Wagering games generally refer to experiences in which a user (referred to as a "patron") places a wager on the outcome of an event (e.g., the outcome being uncertain, at least initially hidden from the patron). A historical example of a wagering game may include three reels configured to spin independently about a shared axis, each reel having a plurality of indicia that may align in varying combination along a pay line. In this example, following initiation of a wagering game, the reels rotate for a particular interval before halting, at which point an outcome of the wagering game is determined based on a subset of the plurality of indicia with which the pay line is aligned. Past approaches to providing a digital wagering game typically include a rendered version of the previous example. However, the translation of wagering games to digital media may allow for expansion of the wagering game experience beyond traditional rotation of indicia along axis-mated reels.

Therefore, there is a long-felt but unresolved need for a system or process that provides for enhanced digital wagering games and experiences.

BRIEF SUMMARY OF THE DISCLOSURE

Briefly described, and according to one embodiment, aspects of the present disclosure generally relate to systems and processes for controlling wagering games.

In various embodiments, the proposed system includes a gaming device that initiates wagering games in response to receiving input from a patron. The gaming device can include an input device for receiving patron inputs, such as, for example, coin-in, commands to initiate or affect a wagering game, and selections for particular fields or options. The gaming device can include one or more displays on which the gaming device renders wagering game interfaces. The gaming device can render digital representations of prismatic objects, such as, for example, cubes, pyramids, and prisms. The gaming device can render indicia onto sides or faces of prismatic objects. For example, the gaming device renders a different flower image onto each of the six faces of a cube. In another example, the gaming device renders a different animated .GIF onto each face of a square-based pyramid.

The gaming device can receive an input to initiate a wagering game, for example, by receiving a particular amount of coin-in. To initiate the wagering game, the gaming device can rotate the digital representation of each prismatic object along one or more axes and at one or more speeds. To complete the wagering game, the gaming device can stop rotation of the digital representations based on a pseudorandom seed or in response to input from a patron. The gaming device can determine the outcome of a wagering game based on the position of indicia in the digital representation as compared to one or more paths drawn across a set of prismatic objects and predetermined indicia combinations with which each path is associated. The gaming device can determine that a particular set of prismatic objects along a particular path include a sequence of indicia that matches a winning combination of indicia with which the particular path is associated. In response to the determination, the gaming device can generate an award on behalf of the patron.

According to a first aspect, a system, comprising: A) a memory; and B) at least one computing device in communication with the memory, the at least one computing device being configured to at least: 1) generate a digital representation of a plurality of prismatic objects, wherein each of the plurality of prismatic objects comprises at least four sides; 2) determine a plurality of sets of indicia from a plurality of indicia, the plurality of sets of indicia individually corresponding to a respective one of the plurality of prismatic objects; 3) generate a user interface for a wagering game comprising the digital representation of the plurality of prismatic objects arranged in a grid, wherein each side of the at least four sides for each of the plurality of prismatic objects comprises a respective indicia from a corresponding one of the plurality of sets of indicia; 4) in response to a user input to initiate the wagering game, rotate the digital representation of each of the plurality of prismatic objects; 5) stop rotation of the digital representation of each of the plurality of prismatic objects with a respective randomly selected side of the at least four sides being shown on the user interface for each of the plurality of prismatic objects; and 6) determine an outcome of the wagering game based on the respective randomly selected side of the at least four sides being shown on the user interface for each of the plurality of prismatic objects.

According to a further aspect, the system of the first aspect or any other aspect, wherein the at least one computing device is further configured to: A) identify one of a plurality of sequences of indicia in one of a plurality of pay lines in the grid; and B) generate an award to the wagering game, wherein the award corresponds to the one of the plurality of sequences of indicia.

According to a further aspect, the system of claim 1, wherein the at least one computing device is further configured to: A) determine that the outcome of the wagering game comprises a predefined set of indicia of the plurality of indicia along a particular path in the grid; and B) generate a bonus game comprising a subset of the plurality of prismatic objects.

According to a further aspect, the system of the first aspect or any other aspect, wherein the at least four sides of each of the plurality of prismatic objects comprises a same number of sides.

According to a further aspect, the system of the first aspect or any other aspect, wherein a respective count of indicia in each of the plurality of sets of indicia equals a respective count of sides of the at least four sides for a corresponding prismatic objects of the plurality of prismatic objects.

According to a further aspect, the system of the first aspect or any other aspect, wherein a count of the plurality of indicia exceeds a count of sides of the at least four sides for each of the plurality of prismatic objects.

According to a second aspect, a method, comprising: A) generating, via at least one computing device, a digital representation of a plurality of prismatic objects; B) assigning, via the at least one computing device, a respective indicia from a plurality of indicia to each side of each of the plurality of prismatic objects; C) generating, via the at least one computing device, a user interface for a wagering game comprising the digital representation of the plurality of prismatic objects arranged in a grid; D) in response to a user input to initiate the wagering game, rotating, via the at least one computing device, the digital representation of each of the plurality of prismatic objects; E) ceasing, via the at least one computing device, rotation of the digital representation of each of the plurality of prismatic objects with a respective randomly selected indicia assigned to a respective side of each of the plurality of prismatic objects being shown on the user interface; and F) determining, via the at least one computing device, an outcome of the wagering game based on the respective randomly selected indicia assigned to the respective side of each of the plurality of prismatic objects being shown on the user interface.

According to a further aspect, the method of the second aspect or any other aspect, further comprising: A) transmitting, via the at least one computing device, a wagered value associated with the wagering game to a remote server associated with a progressive jackpot; B) receiving, via the at least one computing device, a pay amount of the progressive jackpot from the remote server; C) determining, via the at least one computing device, that the outcome of the wagering game corresponds to a progressive award; and D) awarding, via the at least one computing device, the pay amount to the wagering game.

According to a further aspect, the method of the second aspect or any other aspect, further comprising: A) triggering, via the at least one computing device, a shuffle event; and B) changing, via the at least one computing device, a respective position of each prismatic object in a subset of the plurality of prismatic objects within the grid.

According to a further aspect, the method of the second aspect or any other aspect, wherein ceasing the rotation of the digital representation of each of the plurality of prismatic objects comprises decreasing, via the at least one computing device, a rotation speed for each of the plurality of prismatic objects.

According to a further aspect, the method of the second aspect or any other aspect, further comprising replacing, via the at least one computing device and while rotating the digital representation of each of the plurality of prismatic objects, the respective indicia from a particular side of a particular prismatic object of the plurality of prismatic objects with a different indicia from the plurality of indicia.

According to a further aspect, the method of the second aspect or any other aspect, wherein the particular side is in a position hidden from view in the user interface when the respective indicia is replaced with the different indicia.

According to a further aspect, the method of the second aspect or any other aspect, wherein the different indicia comprises a wild indicia.

According to a third aspect, a non-transitory computer-readable medium embodying a program that, when executed by at least one computing device, causes the at least one computing device to: A) generate a digital representation of a plurality of prismatic objects, wherein each of the plurality of prismatic objects comprises at least four sides; B) determine a plurality of sets of indicia from a plurality of indicia, the plurality of sets of indicia individually corresponding to a respective one of the plurality of prismatic objects; C) generate a user interface for a wagering game comprising the digital representation of the plurality of prismatic objects arranged in a grid, wherein each side of the at least four sides for each of the plurality of prismatic objects comprises a respective indicia from a corresponding one of the plurality of sets of indicia; D) rotate the digital representation of each of the plurality of prismatic objects along a respective at least one axis; E) stop the rotation of the digital representation of each of the plurality of prismatic objects with a respective randomly selected side of the at least four sides being shown on the user interface for each of the plurality of prismatic objects; and F) determine an outcome of the wagering game based on the respective randomly selected side of the at least four sides being shown on the user interface for each of the plurality of prismatic objects.

According to a further aspect, the non-transitory computer-readable medium of the third aspect or any other aspect, wherein the program further causes the at least one computing device to: A) rotate a first subset of the plurality of prismatic objects about a first axis; and B) rotate a second subset of the plurality of prismatic objects about a second axis perpendicular to the first axis.

According to a further aspect, the non-transitory computer-readable medium of the third aspect or any other aspect, wherein the program further causes the at least one computing device to rotate a third subset of the plurality of prismatic objects about both the first axis and the second axis.

According to a further aspect, the non-transitory computer-readable medium of the third aspect or any other aspect, wherein the first subset and the second subset are mutually exclusive with each other.

According to a further aspect, the non-transitory computer-readable medium of the third aspect or any other aspect, wherein the program further causes the at least one computing device to: A) determine that a combination of indicia on a subset of the plurality of prismatic objects along a particular pay line omits a winnable combination; and B) in response to determining that the combination of indicia along the particular pay line omits the winnable combination, determine an updated plurality of sets of indicia from the plurality of indicia; and C) update each of the plurality of prismatic objects based on a respective one of the updated plurality of sets of indicia.

According to a further aspect, the non-transitory computer-readable medium of the third aspect or any other aspect, wherein the program further causes the at least one computing device to fix a particular one of the plurality of prismatic objects from rotating for a predetermined number of wagering games.

According to a further aspect, the non-transitory computer-readable medium of the third aspect or any other aspect, wherein the particular one of the plurality of prismatic objects is fixed from rotating for the predetermined number of wagering games based on the outcome of the wagering game.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE FIGURES

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1A:
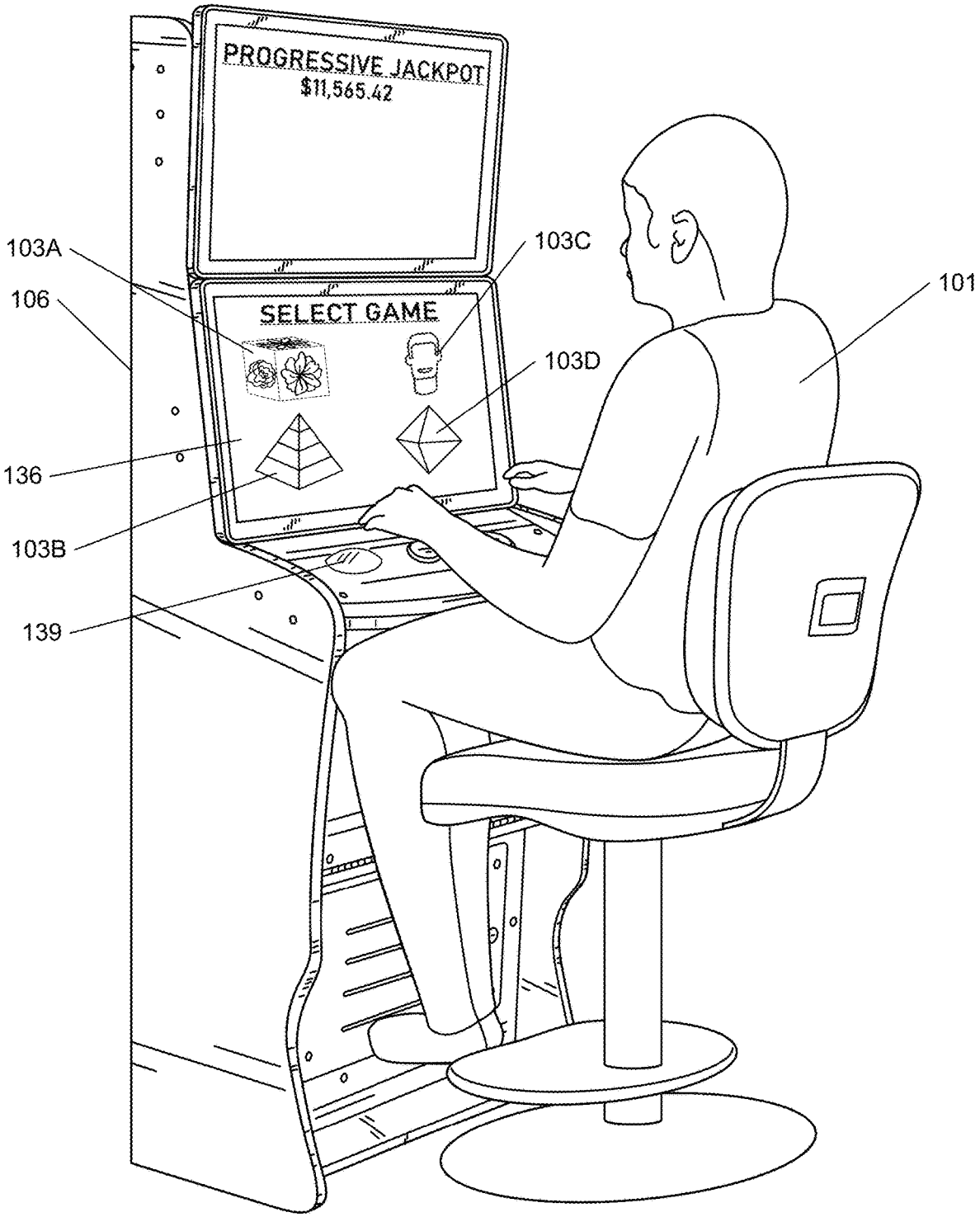
FIG. 1A shows an exemplary gaming area according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

Aspects of the present disclosure generally relate to configuration and rendering of wagering games.

Exemplary Embodiments

Figure 1B:
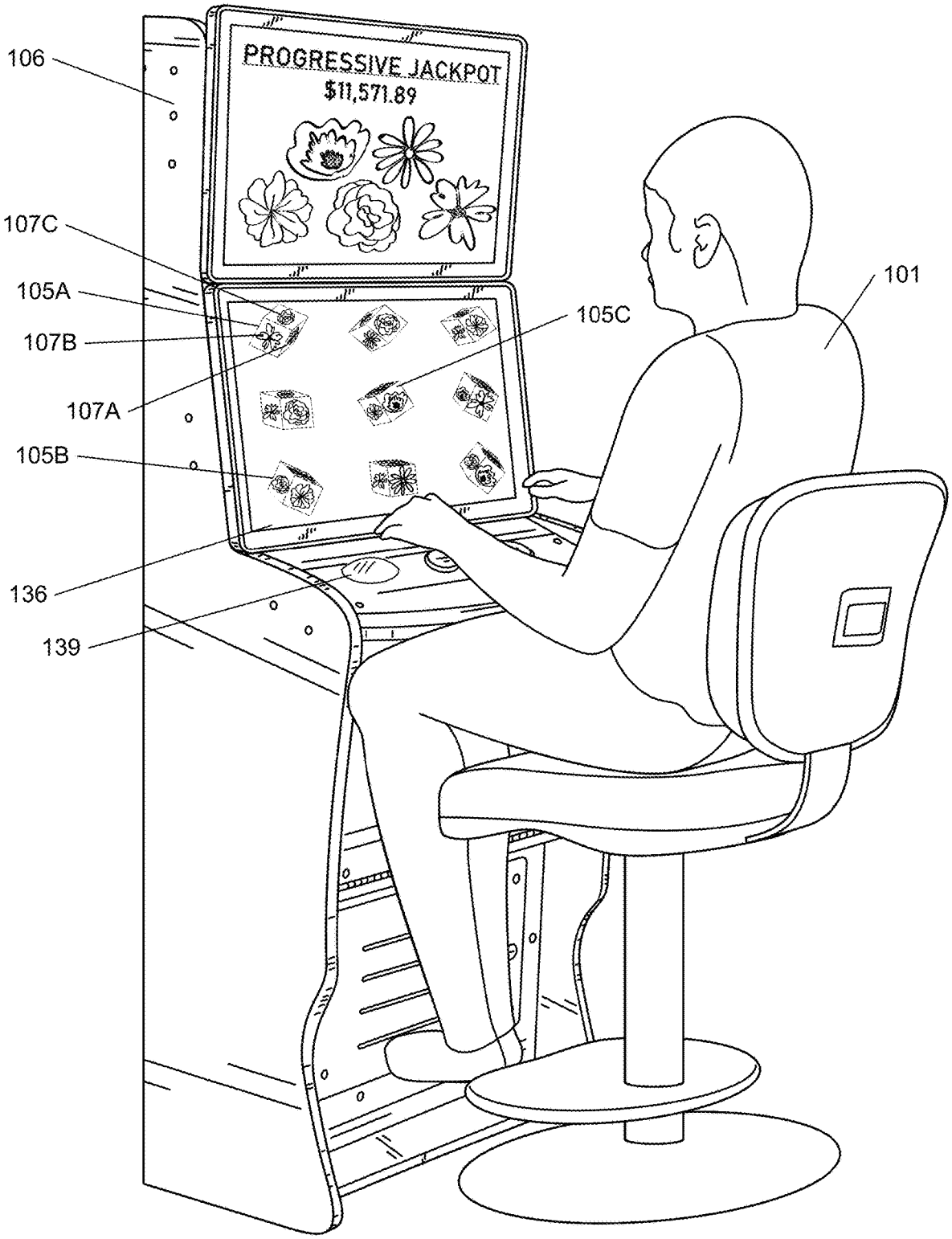
FIG. 1B shows an exemplary gaming area according to one embodiment of the present disclosure.
Figure 1C:
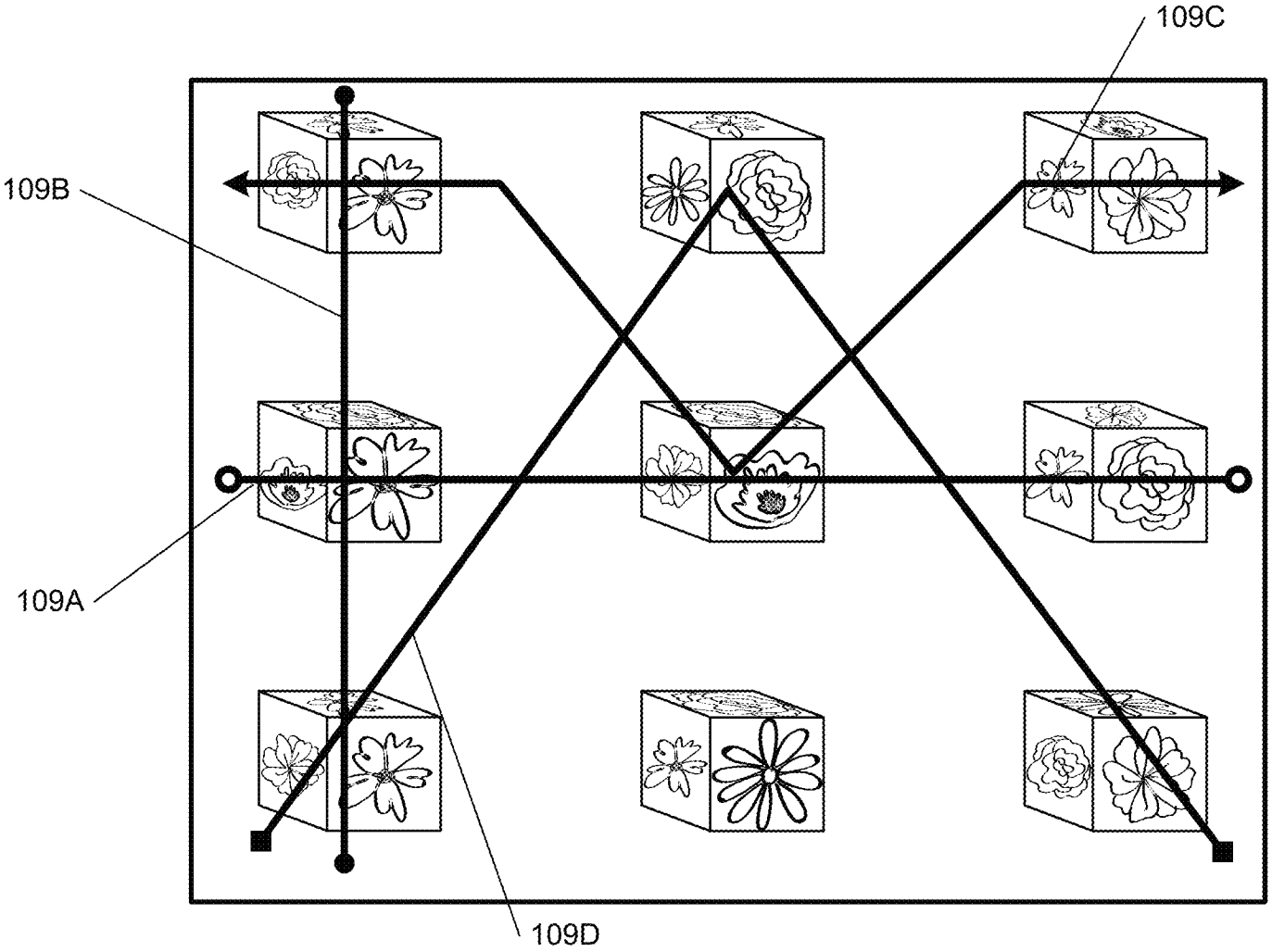
FIG. 1C shows an exemplary gaming area according to one embodiment of the present disclosure.

Referring now to the figures, for the purposes of example and explanation of the fundamental processes and components of the disclosed systems and processes, reference is made to FIG. 1, which illustrates an exemplary gaming area 100A. As will be understood and appreciated, the gaming area 100A shown in FIG. 1A (e.g., and other elements represented in FIGS. 1B-C and FIGS. 2-9) represents merely one approach or embodiment of the present system, and other aspects are used according to various embodiments of the present system.

Referring to FIG. 1A, shown is an exemplary gaming device 106 and a patron 101 seated thereat. The gaming device 106 can include, for example, an amusement device, a slot machine, or other gaming device with a processor-based system such as a computer system. Such a computer system may be embodied in the form of a computing device in a slot machine cabinet, a desktop computer, a laptop computer, personal digital assistants, cellular telephones, smartphones, set-top boxes, music players, web pads, tablet computer systems, game consoles, electronic book readers, or other devices with like capability. The gaming device 106 can include a display 136. The display 136 can include, for example, one or more devices such as liquid crystal display (LCD) displays, gas plasma-based flat panel displays, organic light-emitting diode (OLED) displays, electrophoretic ink (E ink) displays, LCD projectors, or other types of display devices, etc. In one example, a display 136 includes two monitors stacked vertically. The input device 139 can include one or more buttons, touch screens including three-dimensional or pressure-based touch screens, cameras, finger print scanners, accelerometers, retinal scanners, gyroscopes, magnetometers, track balls, gesture recognition devices, virtual or augmented reality devices, mouse, or other input devices. The input device 139 can also include a bill acceptor, a player tracking module, a ticket printer, or some other device.

The gaming device 106 can receive an input from the patron 101 and, in response, initiate a wagering game. In various embodiments, the gaming device 106 renders, on the display 136, one or more selectable fields 103A-D. As the patron 101 controls the gaming device 106 using the input device 139, the gaming device 106 can produce particular outcomes based on the actions of the input device 139. For example, the gaming device 106 can display a cursor on the screen that is controllable using the scroll wheel input device 139. Continuing this example, the gaming device 106 can highlight and enlarge a selectable field 103A-D after a patron 101 has moved the cursor over the particular selectable field 103A-D.

The selectable field 103A-D can relate to particular services provided by the gaming device 106. The services provided by the gaming device 106 can include, but are not limited to, games, setting management, and account information. For example, a patron 101 can initiate a wagering game by selecting any of the four selectable fields 103A-D. In particular embodiments, each selectable field 103A-D pertains to a different wagering game (e.g., or to a prismatic object or type of indicia that may be used for a particular wagering game). A prismatic object can be defined as a three dimensional object used by the gaming device 106 to manipulate position and arrangement of indicia for the purposes of determining the outcome of a wagering game. For example, the selectable field 103A includes a six-sided cube and the corresponding wagering game utilizes a plurality of cubes as prismatic objects. In another example, the selectable field 103B includes a square-based pyramid and the selectable field 103D includes a rhomboid for use as prismatic objects. In another example, the selectable field 103C is associated with a wagering game in which the patron's own likeness (e.g., "selfies" and other photos of the patron) is used to generate indicia that are subsequently rendered onto prismatic objects and used to conduct a wagering game. The indicia can be any image or video. The gaming device 106 can render indicia onto each side of a prismatic object (e.g., or a subset of sides). In one example, the gaming device 106 includes a camera input device 139 that captures six unique images of the patron 101. Continuing this example, the gaming device 106 renders these captured images on a six-sided cube to use as the wagering game's prismatic object.

In some embodiments, the gaming device 106 can render an award on the display 136, such as, for example, a major jackpot or progressive award. The progressive award or progressive jackpot (synonymous to progressive award) can be defined as a particular amount that increments in value each time the patron 101 fails to reach the requirements to win the particular amount. When a patron 101 wins the progressive award, the patron 101 can receive credits for the earnings, while the particular amount can reset to a predetermined sum.

Referring now to FIG. 1B, shown is the gaming device 106 following initiation of a wagering game. In various embodiments, after a user selects the selectable field 103A (see FIG. 1), a wagering game commences. The gaming device 106 can render an at least two-dimensional grid of prismatic objects 105A-C. The prismatic objects 105A-C share the same indicia 107A-C. For example, the gaming device 106 renders a 3×3 wagering game with nine cubes as the prismatic objects 105A-C. The gaming device can render six indicia on each cube (e.g., one indicia per side or face of the cube). In at least one embodiments, each indicia 107A-C is unique and is rendered once on each side of the prismatic object 105A-C. In some embodiments, the prismatic objects 105A-C are identical. In alternative embodiments, the prismatic objects 105A-C are different, but include the same indicia 107A-C.

When the wagering game commences, the gaming device 106 displays rotating prismatic objects 105A-C. In some embodiments, the prismatic objects 105A-C rotate in an unpredictable or random pattern. The rotation of the cubes can continue for a predetermined amount of time. Once the gaming device 106 has reached the predetermined amount of time, the gaming device 106 can render a randomly selected side of the prismatic objects 105A-C.

Referring now to FIG. 1C, illustrated is a completed wagering game, according to one embodiment of the present disclosure. The display 136 can render the selected indicia 107A-C in the 3×3 gridded pattern. In particular embodiments, the gaming device 106 stores a plurality of pay lines 109A-D. The pay line can be defined as a combination of indicia 107A-C distributed across a known pattern that generates a winning combination. The gaming device 106 can have a finite or infinite number of pay lines. For example, the pay lines 109A, 109B mark a winning combination of three identical indicia repeated in a row or column, respectively. In another example, the pay line 109C marks a winning combination of three specific indicia distributed across the V shaped line. The pay line 109 need not be confined to a uniaxial path. For example, the pay line 109 may cross multiple planes in a three-dimensional trajectory such that non-adjacent prismatic objects may be intersected by the pay line without crossing adjacent prismatic objects.

The gaming device 106 can determine an outcome based on the final state of the wagering game and the predefined pay line requirements. An outcome can be defined as a win or a loss depending on the final displayed indicia of the particular wagering game as compared to one or more pay lines and winning indicia combinations associated therewith. For example, the gaming device 106 may award the patron 101 awards for two pay lines 109A and 109B in response to determining that the corresponding indicia located along the pay lines 109A, 109B match the winning indicia combinations with which the respective pay line 109A, 109B is associated.

Figure 2:
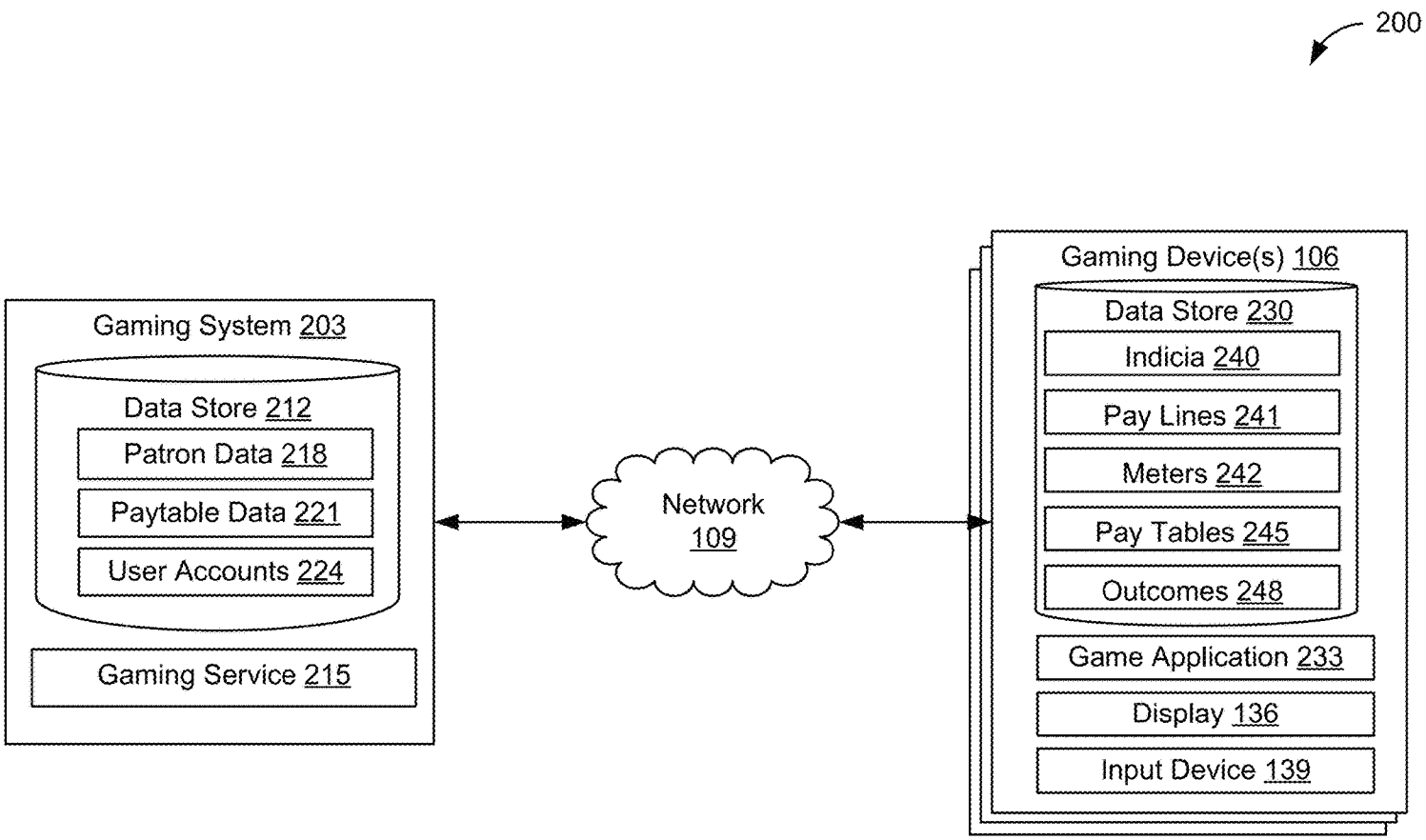
FIG. 2 shows an exemplary gaming environment according to one embodiment of the present disclosure.

FIG. 2 shows a gaming environment 200 that includes one or more gaming devices 106 in communication with a gaming system 203. The gaming device 106 can include, but is not limited to, physical gaming stations (e.g., video screen slot machines and the like), mobile devices (e.g., smartphones, tablets, and smart accessories), electronic gaming consoles, software applications, virtual devices, and other offline or online digital environments. In one example, the gaming device 106 includes an application that may be installed on a smartphone and initiated to access wagering games. In another example, the gaming device 106 includes a physical kiosk or station. The gaming device 106 can communicate with the gaming system 203 via a network 209. The network 209 includes, for example, the Internet, intranets, extranets, wide area networks (WANs), local area networks (LANs), wired networks, wireless networks, or other suitable networks, etc., or any combination of two or more such networks. For example, such networks can include satellite networks, cable networks, Ethernet networks, and other types of networks.

The gaming device 106 may be representative of a plurality of gaming devices that may be coupled to the network 209. The gaming device 106 can include a data store 230, a game application 233, one or more displays 136, and one or more input devices 139, among other components. In some embodiments, the game application 233 is a software program that is downloaded onto the gaming device 106 and executed to provide wagering game functionality. In one example, the game application 233 is a mobile application that can be downloaded to a mobile device, such as, for example, a smartphone, laptop, or gaming console. In another example, the game application 233 is a software program provided by the gaming service 215 to one or more gaming devices 106 (e.g., and the game application 233 may be updated and maintained via the gaming service 215). In another example, the game application 233 is a virtual server hosted in a cloud computing environment. In another example, the game application 233 is an application or other program that is served to and executed by a user's web browser.

The data stored in the data store 230 for example, is associated with the operation of the various applications and/or functional entities described below. The data store 230 can store, for example, indicia 240, pay lines 241, meters 242, pay tables 245, and outcomes 248. The data store 230 can be representative of a plurality of data stores 230 as can be appreciated. The data store 230 can be physical memory of a computing device, a remote storage environment (e.g., a remote server), a cloud storage environment, or any other suitable storage medium.

The indicia 240 can include any digital media, such as, for example, image files or video files. In one example, the indicia 240 include photos of various flowers, photos of various planets, and photos of celebrities. In another example, the indicia 240 includes images of one or more patrons. The pay lines 241 can include data describing pathways that may be drawn across a digital representation of a wagering game to determine if a winning combination of indicia 240 are present in the digital representation. The data store 230 stores meters 242 including, for example, a number of games played on the gaming device 106 and a number of wagering game inputs (for example, one or more "nudge" movement commands that cause adjustment to a final position of an indicia 240 or prismatic object including the same). The meters 242 can include an amount of money wagered on the gaming device 106 referred to as coin-in, an amount won by the gaming device 106 referred to as coin-out, a count of games played on the gaming device 106, an amount of credits currently on the gaming device 106 referred to as current credits, and various jackpot and bonus information, among other meters. It can be appreciated that money or coin-in as used herein for a wager can include non-monetary credits for social wagering of virtual currency that may or may not have a real world value. The pay tables 245 can describe winning combinations of indicia 240 (e.g., and, in some embodiments, as related to pay lines 241) and awards that may be provided for achieving a particular winning combination during a wagering game. The outcomes 248 can include historical records of wagering games, such as, for example, the final positioning and type of indicia 240 at the end of a wagering game. The outcomes 248 can include, for example, all possible winning combinations for a particular wagering game.

The gaming device 106, via the game application 233, can generate and initiate wagering games. The game application 233 can generate wagering game outcomes, for example, by cycling or moving digital objects that include a plurality of indicia 240 based on a pseudo-random seed value. The game application 233 can determine the outcome of a wagering game, for example, by comparing one or more pay lines 241 to a set of indicia 240 visible on a gaming screen when an outcome is rendered and determining one or more sequences of the set of indicia 240 that align with the one or more pay lines 241. In addition, the game application 233 can compare a plurality of indicia 240 that are in alignment with a pay line 241 to a pay table 245 (e.g., which may or may not be viewable by patrons) and, thereby, determine if an award, bonus, or other event or action is associated with the wagering game outcome.

The game application 233 can generate and cause a display 136 to render digital representations of prismatic objects, such as, for example, cubes, spheres, pyramids, and any other two- or three-dimensional shape. In one example, the gaming device 106 renders nine digital representations of cubes and arranges the digital representations into a 3×3 matrix. The game application 233 can determine and render one or more indicia 240 on a digital representation. For example, the game application 233 determines a subset of indicia 240 from a predetermined set of indicia 240 and renders one of each of the subset of indicia 240 onto a face of a prismatic object. In a particular example, the game application 233 generates nine digital representation of a cube, determines six particular indicia 240 from a plurality of indicia 240, and generates a user interface for a wagering game in which each side of each cube includes one of the six particular indicia 240. In another example, the game application 233 renders, a 2×2, 3×3, 4×4, 3×4, 5×5, 4×5, 6×6, 5×6, 4×6, 3×6, 7×7, 7×6, 7×5, 7×4, or another combination of prismatic objects in a user interface (e.g, 2×3 can mean two rows and three columns of prismatic objects or two columns and three rows of prismatic objects). In another example, the game application 233 renders a 2×2 grid of prismatic objects in a user interface. In this example, the game application 233 renders each prismatic object as a 7-sided virtual object, such as, for example, a pentagonal prism. Continuing the example, on each of five side surfaces of each prismatic object, the game application 233 renders a particular indicia. As described herein, the game application 233 can render a number of indicia that exceeds the number of surfaces of a prismatic object by selectively rendering a particular indicia when said indicia is visible to a patron, de-rendering the particular indicia when said indicia is no longer visible to a patron (e.g., due to rotation out of the patron's field of view), and replacing the particular by rendering a new indicia while the particular indicia is unobservable to the patron.

The game application 233 can generate wagering game animations, such as, for example, an animation including rotating digital representations of prismatic shapes. The gaming device 106 can cause each of a plurality of digital representations to rotate and/or translate in one or more directions, at one or more speeds, and in one or more patterns. In other words, whereas historical wagering game displays typically include two-dimensional digital renderings of vertically rotating reels, the game application 233 can render wagering game displays including three-dimensional objects with highly variant motion paths that provide for a more engaging and dynamic visual experience as compared to the traditionally fixed motion paths of previous gaming devices. The game application 233 can cause independent rotation of individual digital representations and subsets thereof. For example, for a user interface including a 3×3 grid of pyramid representations, the gaming device 106 causes a first subset of three pyramids to rotate clockwise in a horizontal direction, causes a second subset of three additional pyramids to rotate counterclockwise in a vertical direction, and causes a third subset of three additional pyramids to rotate clockwise along a diagonal axis. The game application 233 can configure one or more rotation properties of a digital representation based on a pseudorandom seed value. For example, the gaming device 106 determines one or more of rotation speed, rotation direction, and rotation duration based on a pseudorandom seed value (e.g., which may be bound to a particular predetermined range).

In one embodiment, the patron can configure the rotational properties of various prismatic objects. As an example, the game application 233 can offer the patron 12 (or other count of options) directional spin options. In some embodiments, the game application 233 can base the count of spin options offered to a patron on a history of wagering or tier of a user account for the patron (e.g., gold tier can select 12 options, silver tier can select 9 options, etc.). The patron can select to spin 3 of 9 prismatic objects in a 3×3 wagering game up and down, while selecting 9 of 9 prismatic objects left and right. The wagering game can rotate the 3 of 9 prismatic objects that include two directions of travel in both directions simultaneously, while only rotating the 6 of 9 remaining in a single axis of rotation.

The gaming system 203 can generate, store, and update various information that may be used to initiate or otherwise affect wagering games at one or more gaming devices 106. The gaming system 203 can include, for example, a point of sale "POS" system, a server computer, or any other system providing computing capability. Alternatively, the gaming system 203 may employ computing devices that may be arranged, for example, in one or more server banks or computer banks or other arrangements. Such computing devices can be located in a single installation or may be distributed among many different geographical locations. For example, the gaming system 203 can include computing devices that together may include a hosted computing resource, a grid computing resource, and/or any other distributed computing arrangement. In some cases, the gaming system 203 can correspond to an elastic computing resource where the allotted capacity of processing, network, storage, or other computing-related re-sources may vary over time.

Various applications and/or other functionality may be executed in the gaming system 203 according to various embodiments. The components executed on the gaming system 203, for example, include a gaming service 215, and other applications, services, processes, systems, engines, or functionality not discussed in detail herein. The gaming service 215 can be executed to monitor game play on the one or more gaming devices 106 and facilitate additional features on the gaming devices 106. As an example, the gaming service 215 can facilitate the storing and transferring of custom indicia 240 from one gaming device 106 to another gaming device 106 and awarding bonuses to a patron, among other features. In one example, the game application 233 on a first gaming device 106 can provide a configurable user interface to allow a patron to select preferred indicia. In the same example, the gaming service 215 can store the preferred indicia and send the preferred indicia to a second gaming device 106 when the patron authenticates with the second gaming device 106 (e.g., via inserting a player card).

Also, various data is stored in a data store 212 that is accessible to the gaming system 203 and the gaming device 106. The data store 212 can be representative of a plurality of data stores 212 as can be appreciated. The data stored in the data store 212, for example, is associated with the operation of the various applications and/or functional entities described below. The data stored in the data store 212 includes, for example, patron data 218, pay table data 221, user accounts 224, and potentially other data. The patron data 218 can include data for user accounts 224, indicia 240, and potentially other data. In one example, patron data 218 includes one or more media files from which indicia 240 are extracted and utilized during wagering game execution. The pay table data 221 can include awards and winning indicia combinations associated therewith. The pay table data 221 can include, for example, jackpot amounts and other awards that may be incremented and/or decremented as wagering games are initiated at one or more gaming devices 106. The user account 224 can include authentication credentials, a user identifier, contact information, user preferences, or other identifying information. The user identifier can correspond to an identifier stored in a magnetic strip of a patron tracking card. In some embodiments, the patron data 218 can correspond to an anonymous patron. As an example, a gaming session of an anonymous patron can be tracked as credits, games played, tickets, indicia 240, or other trackable aspects are moved among gaming devices 106.

Figure 3:
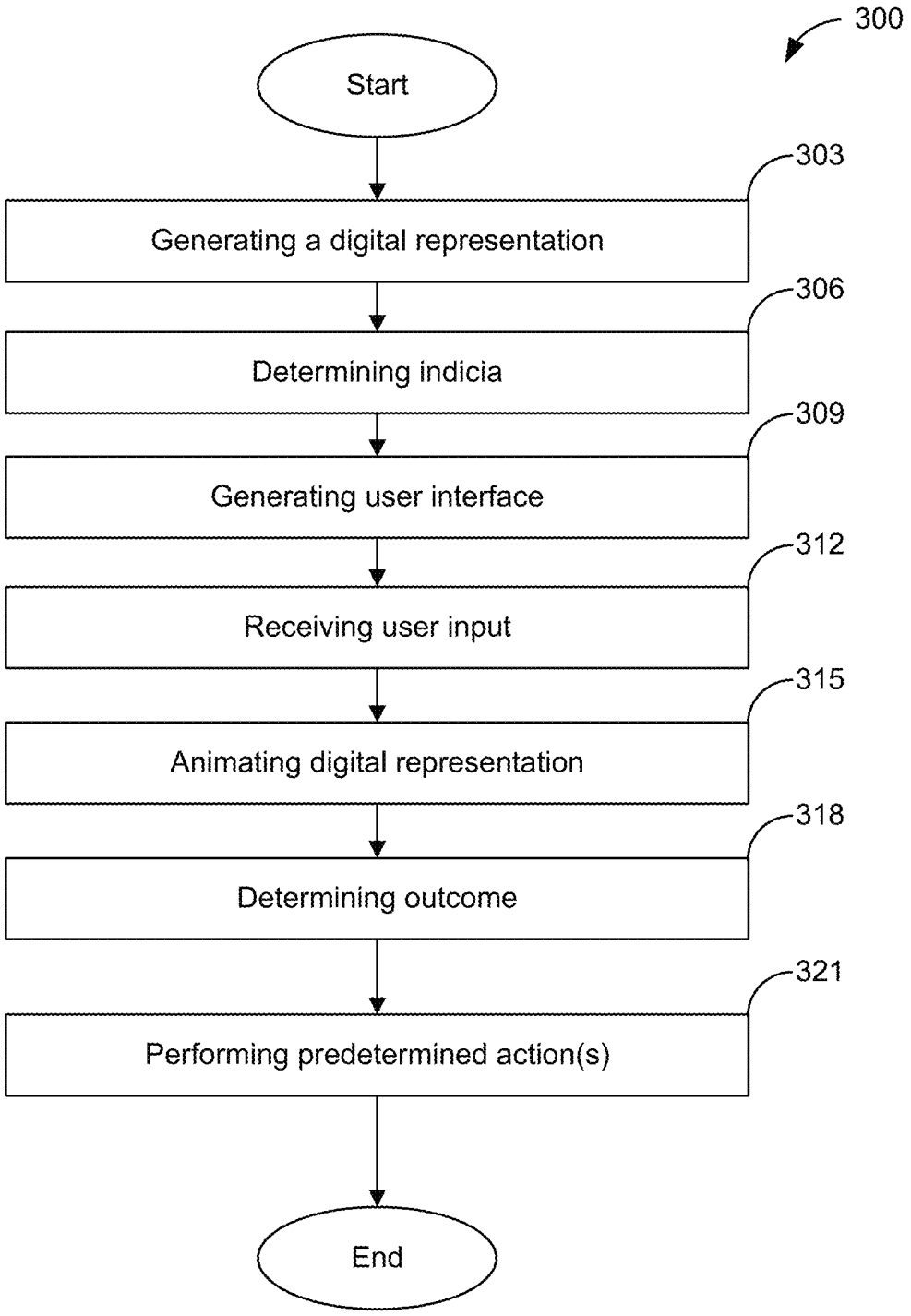
FIG. 3 shows an exemplary wagering game process according to one embodiment of the present disclosure.

As will be understood by one having ordinary skill in the art, the steps and processes shown in FIG. 3 (and those of all other flowcharts and sequence diagrams shown and described herein) may operate concurrently and continuously, are generally asynchronous and independent, and are not necessarily performed in the order shown.

FIG. 3 shows an exemplary wagering game process 300. In at least one embodiment, the gaming device 106 initiates the process 300 in response to being activated (e.g., powered on, initiated as an application, accessed via a network, etc.) or in response to completion of a previous wagering game. In some embodiments, the gaming device 106 initiates the process 300 in response to receiving user input via an input device 139. In one example, the gaming device 106 initiates the process 300 in response to receiving coin-in from a patron. In another example, the gaming device 106 initiates the process 300 in response to receiving a request to initiate a wagering game (e.g., receiving selection of a field or a signal from pressing of a physical button). In another example, the gaming device 106 initiates the process 300 in response to receiving user information, such as, for example, a patron identifier, user account 224 identifier, or other credential.

At step 303, the process 300 includes generating a digital representation. The game application 233 can generating the digital representation by generating a one or more digital objects for presentation to a patron via the display 136. The game application 233 can generate a digital representation of a plurality of prismatic objects. For example, the game application 233 generates a digital representation of 3, 6, 9, or any suitable number of cubes (e.g., each cube including at least three sides visible to a user when rendered on the display 136). The prismatic object can be any shape including, but not limited to, cubes, cuboid, sphere, ellipsoid, cylinder or other solid of revolution, cone, prism, pyramid, or polyhedron-based shape (e.g., tetrahedron, dodecahedron, etc.). The plurality of prismatic objects, or subsets thereof, can be similar or dissimilar in shape. For example, the plurality of prismatic objects includes five cubes, five triangular-based pyramids, and five rectangular prisms. In another example, the plurality of prismatic objects includes a sphere, four triangular-based pyramids, 3 square-based pyramids, and a cube.

In some embodiments, the gaming device 106 receives a user input or other selection for a particular type of digital representation to generate. In one example, the gaming device 106 includes a plurality of wagering game modes, each of the plurality of wagering game modes being associated with a particular set of shapes. In this example, game application 233 generates a user interface including a selectable triangular pyramid shape corresponding to a first game mode, a selectable cube shape corresponding to a second game mode, and a selectable cube shape corresponding to a third game mode. Continuing the example, via the input device 139, the gaming device 106 receives a user's selection for the cube shape and, in response, the game application 233 initiates a wagering game corresponding to the second game mode. In various embodiments, game modes can be associated with varying types or levels of outcome odds, play difficulty, complexity, award, and theme.

In some embodiments, the game application 233 communicates with the gaming service 215 to generate the digital representation. For example, in response to receiving an input for a particular wagering game, the game application 233 transmits a request to the game system 203 for a) one or more execution files corresponding to the particular wagering game (e.g., media files for prismatic shapes, rules and metadata for controlling game parameters, etc.), b) access to a digital environment at which the particular wagering game is hosted, and/or c) permission to initiate the particular wagering game (e.g., based on verification of the gaming device 106 identity, verification of the patron's identity or user account 224, etc.). In at least one embodiment, the game application 233 functions as a point-of-play (PoP) device (e.g., a client gaming device) for displaying user interfaces and receiving user input and the gaming service 215 functions as a wagering game server from which one or more wagering games may be downloaded, streamed, or otherwise rendered accessible to the game application 233.

The game application 233 can generate the digital representation as a gridded arrangement in which a plurality of prismatic shapes are arranged into rows and columns (see, for example, FIGS. 1B-C, 10, 13). In some embodiments, generating the digital representation includes retrieving the digital representation (e.g., or data defining the same) from the data store 230, data store 212, or an external storage environment, such as, for example, a wagering game library of a third party.

At step 306, the process 300 includes determining one or more indicia (for example, indicia 240) to be rendered on one or more prismatic objects of the digital representation. The game application 233 can determine a set of indicia 240 for each prismatic object to be included in the digital representation. The can assign an indicia 240 from each indicia set to a side or face of the corresponding prismatic object.

The number of indicia 240 included in each prismatic object indicia set can be greater than, less than, or equal to a number of sides or faces of the prismatic object or, in particular embodiments, a number of sides or faces of the prismatic object that will be visible to the patron during gameplay. In one example, the game application 233 generates a digital representation including nine cubes in which only four sides of each cube will be visible to a patron at a given moment. Continuing this example, for each cube, the game application 233 determines a set of seven indicia 240 that will be iteratively rendered and de-rendered onto one of the four visible cube sides (e.g., rendering and de-rendering occurring according to a rotation pattern of the cube). In another example, the game application 233 generates a digital representation including a square-based pyramid with four rotatable levels (see, for example, FIG. 7). Continuing the example, the game application 233 determines four images to correspond to each triangular-shaped face of the square-based pyramid. In the same example, to generate indicia 240 for each face, the game application 233 splits the corresponding image into four stripes, each image stripe being an indicia 240 to-be-rendered on the corresponding level of the square-based pyramid.

The game application 233 can automatically retrieve indicia 240 with which the wagering game is associated. For example, in response to receiving a command to initiate a "Tour of the Universe" wagering game, the game application 233 automatically retrieves a plurality of image files associated with galactic bodies and other space-related elements.

In some embodiments, the game application 233 receives an image or string input and determines the plurality of indicia based thereon. The game application 233 can receive one or more of photos from the patron, or a mobile device thereof, and can use the one or more photos to generate one or more indicia 240 for use in the current instance of the wagering game (e.g., different patrons may play the same wagering game with different sets of indicia 240 being presented to each patron). The game application 233 can receive the one or more photos via a) an image capturing input device 139, b) an image upload from the patron, and/or c) retrieval from patron data 218 or a user account 224. The game application 233 can receive a photo from a patron and perform one or more image recognition and/or matching techniques to retrieve additional photos corresponding to the patron photo. The game application 233 can utilize the patron photo and/or one or more matched photos as indicia 240. In one example, the game application 233 receives a patron's own likeness (e.g., referred to as a "selfie" image) and compares the selfie image to a plurality of celebrity images from a database by generating similarity scores therebetween. In this example, the game application 233 generates the indicia 240 based on the selfie image and a subset of top-matched celebrity images.

The game application 233 can receive a text string input defining a particular subject, category, or other type of image for use as indicia 240. In one example, the game application 233 receives a string input for "puppies" and, in response, performs a targeted image search to identify or retrieve a plurality of images associated with puppies. In the same example, the game application 233 uses top-ranked results of the targeted image search to generate a plurality of indicia 240 displaying various puppies. This disclosure contemplates any use of image matching or mismatching (e.g., or text matching or mismatching) as means for determining the indicia 240.

Prior to presentation of the digital representation to the user, the game application 233 can determine a final outcome of the wagering game. The game application 233 can determine the outcome similar to step 318. The game application 233 can determine that the digital representation omits a winning combination of indicia 240. In response to the determination that a winning combination is omitted, the game application 233 can determine an updated set of indicia 240 (e.g., different from the current set of indicia 240 assigned to the plurality of prismatic objects) and update each of the plurality of prismatic objects to replace the current indicia 240 with a corresponding one of the updated set of indicia 240. In other words, prior to presenting the wagering game to the patron, the game application 233 can determine whether it is possible for the patron to win an award based on the current outcome of the wagering game and, if it is not possible, reconfigure the wagering game indicia such that the patron has a non-zero chance of winning an award.

At step 309, the process 300 includes generating a user interface. The game application 233 can generate the user interface by rendering, on the display 136, the digital representation of the plurality of prismatic objects and rendering, on corresponding sides of each prismatic object, the indicia 240 that were determined at step 306. In one example, the game application 233 generates the user interface by rendering, on the display 136, a digital representation of a plurality of prismatic objects arranged in a grid. In this example, the game application 233 further generates the user interface by rendering, on each side of the at least four sides of each of the plurality of prismatic objects a respective indicia 240 from a corresponding one of a plurality of sets of indicia 240 that were determined at step 306.

The user interface can include a selectable field that, when selected, causes the game application 233 to initiate a wagering game. In some embodiments, the user interface includes one or more of a current jackpot amount, a progressive and/or mystery jackpot amount, a bonus game amount, wagering game instructions, pay lines 241, and a pay table 245. The user interface can include selectable fields for causing the display of pay lines 241, a pay table 245, and/or wagering game instructions.

At step 312, the process 300 includes receiving user input. The gaming device 106 can receive, for example, a button selection, touch screen selection, network-based command, card insertion or swipe, or patron identifier. In response to receiving the input, the game application 233 can initiate a wagering game. In some embodiments, the user input includes a patron identifier and/or an identifier with which a user account 224 is associated. In one or more embodiments, the user input includes one or more images and/or one or more text strings for use in the determination of indicia 240. In various embodiments, the user input includes a selection for one or more prismatic objects that, in response to being selected, will be fixed from rotating for a predetermined number of wagering games (e.g., 1, 2, 3, or any suitable number of games). The game application 233 can determine number of wagering games for which rotation of the selected prismatic object will be fixed by determining a number of instances the patron has initiated wagering games (e.g., also referred to as a "hand count") or by determining whether one or more rotation-fixing awards or bonuses were awarded to the patron in a previous wagering game. The game application 233 can determine one or more of the aforementioned factors based on patron data 218, a user account 224 associated with the patron, or historical outcomes 248.

At step 315, the process 300 includes animating the digital representation. In some embodiments, the game application 233 continuously animates the digital representation (e.g., the prismatic objects and indicia 240 thereof) in a first mode (e.g., a display or advertisement mode) and step 315 corresponds to an additional mode in which the game application 233 animates the digital representation according to a pseudorandom seed value and/or a predetermined motion sequence.

The game application 233 can rotate the digital representation of each of the plurality of prismatic objects, or a subset thereof. The game application 233 can rotate a prismatic object along any number of axes. For example, the game application 233 can rotate a prismatic object simultaneously along orthogonal X-, Y-, and Z-axes (e.g., or a subset of the axes, such as X- and Y-axes only). The game application 233 can independently rotate subsets of the plurality of indicia or individual indicia. In one example, for a 3×3 grid of prismatic objects, the game application 233 rotates a first row of prismatic objects along a horizontal axis through a midline of the row, rotates a second row of prismatic objects along individual vertical axes, and rotates a third row of prismatic objects along individual diagonal axes extending through each third row prismatic object. The game application 233 can fix rotation of one or more prismatic objects such that the prismatic object is not rotated during the course of the wagering game. The game application 233 can perform rotation according to user inputs, such as, for example, patron touch inputs (e.g., screen swipes, object taps, etc.), patron button inputs (e.g., inputs to a sequence of directional controls), mouse movements, trackball movements, gestures (e.g., swiping a hand, making a fist, pointing, etc.), and verbal commands.

It can be appreciated that, as a prismatic object rotates, one or more sides or faces of the prismatic object and the indicia 240 assigned thereto may move into and out of view. For example, a cube may rotate such that a front side of the cube rotates 180 degrees and, thus, becomes unobservable to the patron. The game application 233 can rotate a prismatic object and, during rotation, replace the current indicia 240 of a non-viewable side with new indicia 240 (e.g., a wild type indicia or other indicia from the corresponding indicia set with which the prismatic shape is associated). Thus, the number of indicia 240 rendered on a prismatic object during the course of a wagering game may exceed a number of sides or faces of the prismatic object. It can be appreciated that the game application 233 may replace the indicia 240 with sufficient speed such that the unobservable side is assigned new indicia 240 before the prismatic object further rotates to an extent such that the side becomes observable. As used herein, a wild-type indicia generally refers to an indicia that can represent any other particular indicia. For example, a wild-type indicia can simultaneously represent a "rose" and a "diamond" (e.g., and may take on the representation that results in the optimal outcome combination for the patron).

The game application 233 can stop rotation of each of the plurality of prismatic objects such that one or more respective randomly selected sides of the prismatic object are observable on the user interface. The game application 233 can automatically cease rotation of the plurality of prismatic objects following a predetermined time interval or in response to receiving an input from the patron. The game application 233 can cease rotation of one or more prismatic objects simultaneously or in a predetermined sequence (e.g., one object at a time, sequential object rows, sequential object columns, etc.). The game application 233 can cease rotation of the plurality of prismatic objects by decreasing a rotation speed for each prismatic object. In other words, the game application 233 can cause a prismatic object to rotationally decelerate until the prismatic object comes to rest. In some embodiments, the game application 233 ceases rotation of the prismatic object such that at least one side or face of the prismatic object is in full view of the patron. In at least one embodiment, the game application 233 ceases rotation of the prismatic object such that a predetermined number of sides or faces of the prismatic object are viewable by the patron. The predetermined number of sides or faces can include, for example, 2 sides, 3 sides, 4 sides, or any suitable number.

In some embodiments, the game application 233 performs a shuffle event by changing a respective changing a respective position of two or more prismatic objects within the grid. For example, the game application 233 performs a shuffle event by swapping the positions of a top-left prismatic object and a bottom-right prismatic object in the grid. The game application 233 can trigger a shuffle event based on a pseudorandom counter or in response to determining that one or more criteria are met. Non-limiting examples of criteria include coin-in (e.g., minimum threshold value of coin-in or maximum coin-in), performance in a bonus game, outcome of the current or past wagering game (e.g., whether an award was paid out, whether an accrued or paid award value meets a predetermined threshold, etc.), credentials, tier level, or other qualification of the patron or user account 224 associated therewith, and a number of games initiated at the gaming device 106 during a particular time interval. In one example, the game application 233 determines that a patron has initiated a ten wagering games at the same gaming device 106 in the past hour. Continuing the example, the game application 233 determines that the ten-game count exceeds a predetermined shuffle event threshold (e.g., 5, 7, 9, or other suitable number of wagering games) and, in response, the game application 233 triggers a shuffle event. In some embodiments, the game application 233 updates the user interface to include a selectable option for triggering a shuffle event and triggers the shuffle event in response to receiving a selection input for the option.

In at least one embodiment, following rotation cessation, the game application 233 receives a command to adjust (e.g., "nudge") one or more prismatic objects. The game application 233 can further rotate one or more prismatic objects in response receiving adjustment commands. The game application 233 can restrict the patron to a particular number of adjustment commands (e.g., 1, 2, 3, or any suitable number). The game application 233 can allow a patron a particular number of adjustment commands based on one or more factors, such as, for example, a number of wagering games initiated by the patron in a particular interval or an accrued winnings amount reward to the patron over a particular interval and/or total value of coin-in. In one example, the game application 233 determines that the patron has won less than a predetermined amount (e.g., $5, $50, $100, etc.) following a predetermined number of wagering games (e.g., 3, 5, 10, or any suitable number of games). Continuing the example, in response to the determination, the game application 233 awards the patron a particular number of adjustment commands (e.g., 1, 2, 3, or any suitable number) that may be utilized in a subsequent wagering game.

At step 318, the process 300 includes determining an outcome of the wagering game based on the final position and orientation of indicia 240 in the digital representation. The game application 233 can determine an outcome, for example, based on the most prominent side of each prismatic object being shown on the user interface. As used herein, "prominent" may refer to a side of the prismatic object whose visible area is greatest as compared to visible areas of other sides of the prismatic object. In some embodiments, the game application 233 receives a selection of which side(s) of each prismatic object may contribute to a wagering game outcome. In one example, the game application 233 rotates the digital representation as a whole and, thereby, allows the patron to observe multiple combinations of indicia 240 rendered on various sides of the prismatic objects. In this example, the application 233 receives a selection to cease rotation of the digital representation at a particular predetermined orientation (e.g., original view, 90 degrees rotated from original view, 180 degrees rotated from original view, 270 degrees rotated from original view, etc.). In the same example, the game application 233 determines an outcome of the wagering game based on the most prominent side of each prismatic object as shown in the selected orientation.

The game application 233 can determine an outcome by comparing the arrangement of indicia 240 in the digital representation to one or more predetermined indicia combinations associated with an outcome 248. The game application 233 can determine an outcome by comparing the final position and type of the plurality of indicia 240 to one or more predetermined paths in the grid (e.g., or other configuration into which the plurality of prismatic objects are arranged). For example, the game application 233 determines that a plurality of identical indicia 240 (e.g., or a particular sequence of indicia 240) are aligned with a particular line drawn across the grid, and, in response, the game application 233 determines the outcome to be an award or other result with which the particular line is associated. As used herein, the particular lines to which indicia 240 are compared may be referred to as "pay lines." Any number and any configuration of pay lines and indicia sequences is contemplated. In some embodiments, the game application 233 evaluates particular pay lines 241 based on one or more criteria, such as, for example, an amount of coin-in or other wager provided by the patron or a number of wagering games played by the patron within a predetermined interval (e.g., 24 hours, 1 week, 1 month, etc.). In one example, the game application 233 determines that the patron provided less than a maximum amount of coin-in and, in response, evaluates only a subset of possible pay lines 241. In another example, the game application 233 determines that the patron wagered a maximum amount and, in response, evaluates all possible pay lines 241.

The game application 233 can determine that multiple pay lines 241 are satisfied. For example, the game application 233 determines that a first combination of indicia along a first particular path satisfies a first pay line 241 and determines that a second combination of indicia along a second particular path satisfies a second pay line 241 (e.g., the second combination including or excluding one or more indicia of the first combination. The game application 233 can determine that one or more particular pay lines 241 are not satisfied. For example, the game application 233 can determine that a combination of indicia along a particular pay line 241 omits a winnable combination.

The game application 233 may further determine or affect the wagering game outcome based on a value of coin-in with which the wagering game is associated and/or based one or more meters 242 with which the patron and/or the wagering game are associated. In one example, the game application 233 transmits a wagered value associated with the wagering game to a remote server associated with a progressive jackpot. Continuing the example, the game application 233 receives, from the remote server, a pay amount of the progressive jackpot from the remote server. In the same example, the game application determines that the outcome of the wagering game corresponds to a progressive award and, in response, awards the pay amount to the wagering game. In another example, the game application 233 determines that the wagered value, when added to the pay amount of the progressive award, causes the progressive award to meet or exceed a predetermined payout threshold. Continuing the example, in response to determining the incremented pay amount exceeds the predetermined payout threshold, the game application awards the incremented pay amount to the wagering game.

At step 321, the process includes performing one or more appropriate actions. The game application 233 can generate an award and apply the award to the wagering game, the gaming device 106, patron data 218, and/or user account 224. The game application 233 can generate the award based on a pay table 245 with which the wagering game and the one or more satisfied pay lines 241 are associated. For example, the game application 233 determines that a subset of the plurality of prismatic objects along a particular pay line 241 includes a combination of indicia that matches a winning combination with which the particular pay line 241 is associated. Continuing the example, in response to the match, the game application 233 increments a winnings meter 242 by a jackpot amount, thereby allowing the patron to redeem their winnings (e.g., or a subset thereof) by requesting a payout. In some embodiments, the jackpot amount can correspond to a mystery progressive configured to award the progressive amount when a value of the progressive meets or exceeds a randomly or pseudo-randomly determined threshold amount. The amount can be awarded to the patron that played the coin-in that caused the amount to meet or exceed the threshold amount.

The game application 233 can update the user interface to include various wagering game information, such as, for example, an indication that the patron achieved a winning outcome, an award associated with the winning outcome, a pay table 245, and the particular outcome 248 with which an award is associated. The game application 233 can cause the gaming device 106 to execute various effects, such as, for example, light, sound, or vibrational effects. The game application 233 can generate and transmit an alert to one more of the gaming service 215, the user account 224 with which the patron is associated, a mobile device with which the patron is associated, or one or more network environments with which the patron is associated (e.g., a social media account, wagering game tracking website, etc.). The game application 233 or the gaming service 215 can update patron data 218 and/or a user account 224 to include wagering game data, such as, for example, the winning outcome of the wagering game, the award that was provided to the patron, and a number of wagering games initiated by the patron at the gaming device 106.

The game application 233 can generate one or more bonus games. The game application 233 can determine that a subset of the plurality prismatic objects include a winning combination of indicia 240. The game application 233 can initiate a bonus game including the subset of the plurality of prismatic objects. For example, the game application 233 determines that a sequence of three cubes includes a winning combination of flower-themed indicia along a particular pay line. Continuing the example, the game application 233 initiates a bonus game in which the three cubes and flower-themed indicia are rendered selectable and the patron may select one of the three cubes to reveal and receive a bonus award.

In some embodiments, the game application 233 receives a request to initiate payout or redemption of an award and, in response, the game application 233 causes one or more payout actions. Non-limiting examples of payout actions include awarding digital credit to a user account 224, printing a voucher or receipt for the award (e.g., or an incremented winnings amount), initiating a bonus game, or modifying one or more aspects of subsequent wagering games initiated at the gaming device 106 and/or by the patron.

The game application 233 can fix one or more prismatic objects from rotation in one or more subsequent wagering games. The game application 233 can fix prismatic objects against rotation based on the outcome of the current wagering game. For example, the game application 233 determines that an award for a current wagering game is less than a predetermined award threshold. Continuing the example, in response to the determination, the game application 233 fixes at least one prismatic object of the current wagering game against rotating in the next wagering game initiated at the gaming device 106. The game application 233 can fix a prismatic object against rotation and, in some embodiments, secure a grid position of the prismatic object such that the prismatic object (e.g., and the indicia 240 rendered thereon) are located in the same position in a subsequent wagering game). The game application 233 can fix a prismatic object against rotation for a predetermined number of subsequent wagering games (e.g., 1, 2, 3, or any suitable number of wagering games). For example, the game application 233 fixes a top right-positioned prismatic object against rotation in two subsequent wagering games such that the prismatic object remains positioned in the top-right space of the grid and at the same rotation orientation at least until completion of the second subsequent wagering game.

Figure 4:
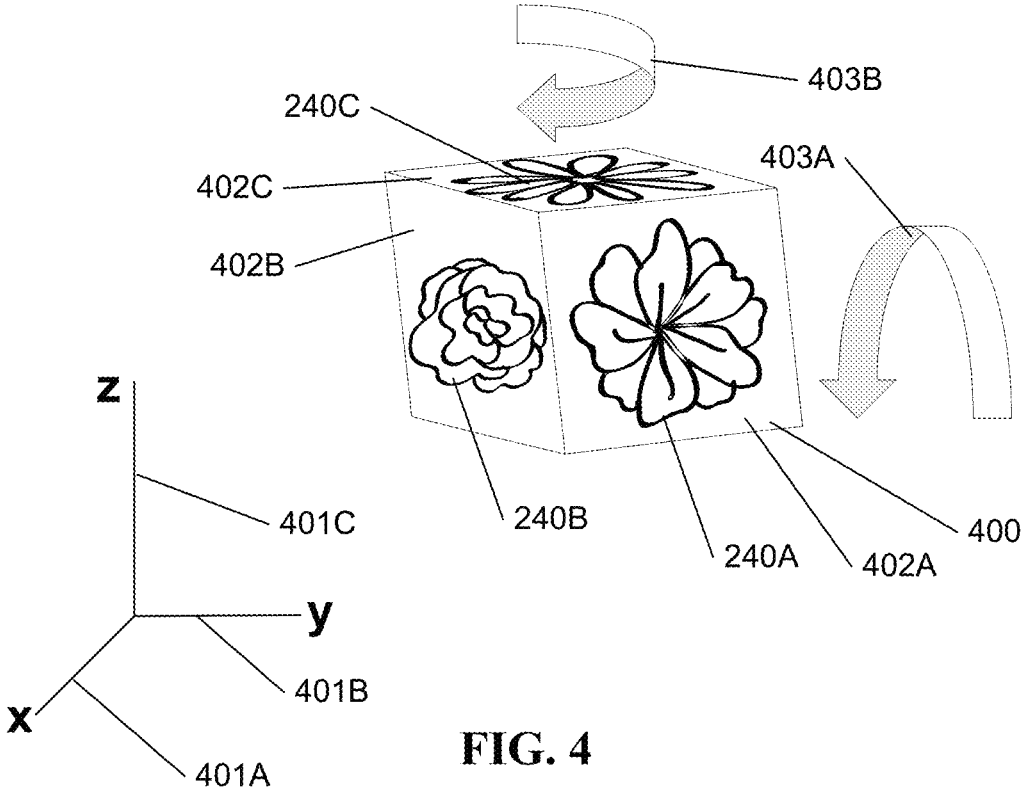
FIG. 4 shows an exemplary prismatic object according to one embodiment of the present disclosure.

FIG. 4 shows an exemplary prismatic object 400. The gaming device 106 (FIG. 1) can rotate the prismatic object 400 along one or more axes 401A-C. The gaming device 106 can rotate the prismatic object 400 along a first axis 401A at a first rotational speed and, simultaneously, rotate the prismatic object 400 along a second axis 401B at a second rotational speed that may be greater than, less than, or equal to the first speed. In one example, the gaming device 106 rotates the prismatic object 400 in a counterclockwise direction 403A along an axis 401B (e.g., a Y-axis) and, simultaneously, rotates the prismatic object 400 in a clockwise direction 403B along an axis 401C (e.g., a Z-axis).

The prismatic object 400 can include a plurality of sides 402A-C. Each side 402A-C (e.g., and other sides not visible in FIG. 400) can include an indicia 240A-C. The sides 402A-C can include identical or dissimilar indicia 240A-C. In some embodiments, one or more sides 402A-C include a "wild" indicia that may represent any indicia 240A-C. In at least one embodiment, the gaming device 106 may allow a patron to input a selection of a particular indicia 240A-C and, in response, the gaming device 106 can convert the particular indicia 240A-C to a wild indicia.

Figure 5:
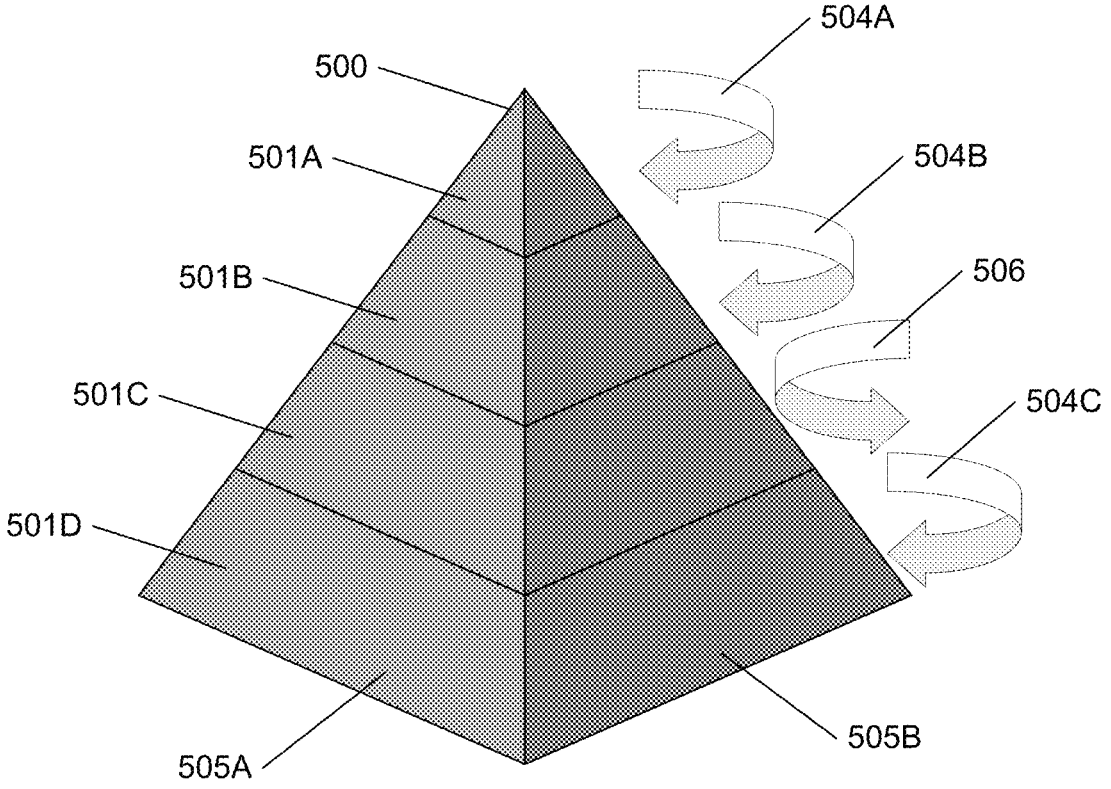
FIG. 5 shows an exemplary prismatic object according to one embodiment of the present disclosure.

FIG. 5 shows an exemplary prismatic object 500. Similar to the prismatic object 400 (FIG. 4), the prismatic object 500 can be rotated in multiple directions and at multiple speeds. The prismatic object 500 can include a plurality of rotatable portions 501A-D that can each be rotated independently of other rotatable portions. The rotatable portions 501A-D can be rotated simultaneously with overall rotation of the prismatic 500. For example, the gaming device 106 can rotate the first, second, and fourth rotatable portions 501A, 501B, 501D in a clockwise direction 504A-C (e.g., at the same or dissimilar speeds). In the same example, simultaneous to the rotation of portions 501A, 501B, 501D, the gaming device 106 can rotate the third rotatable portion 501C in a counterclockwise direction 506 (e.g., at the same speed or a dissimilar speed as the rotational speeds of other portions). Each rotatable portion 501A-D can include a plurality of sides 505A-B (e.g., and other sides not visible in FIG. 5) and each of the plurality of sides 505A-B can include the same or different indicia (not shown in FIG. 5). In at least one embodiment, the gaming device 106 conducts a wagering game by generating the prismatic object 500, rendering indicia onto each side of each portion 501A-D thereof, and rotating the portions 501A-D to generate one or more wagering game combinations.

VR Integration

Figure 6:
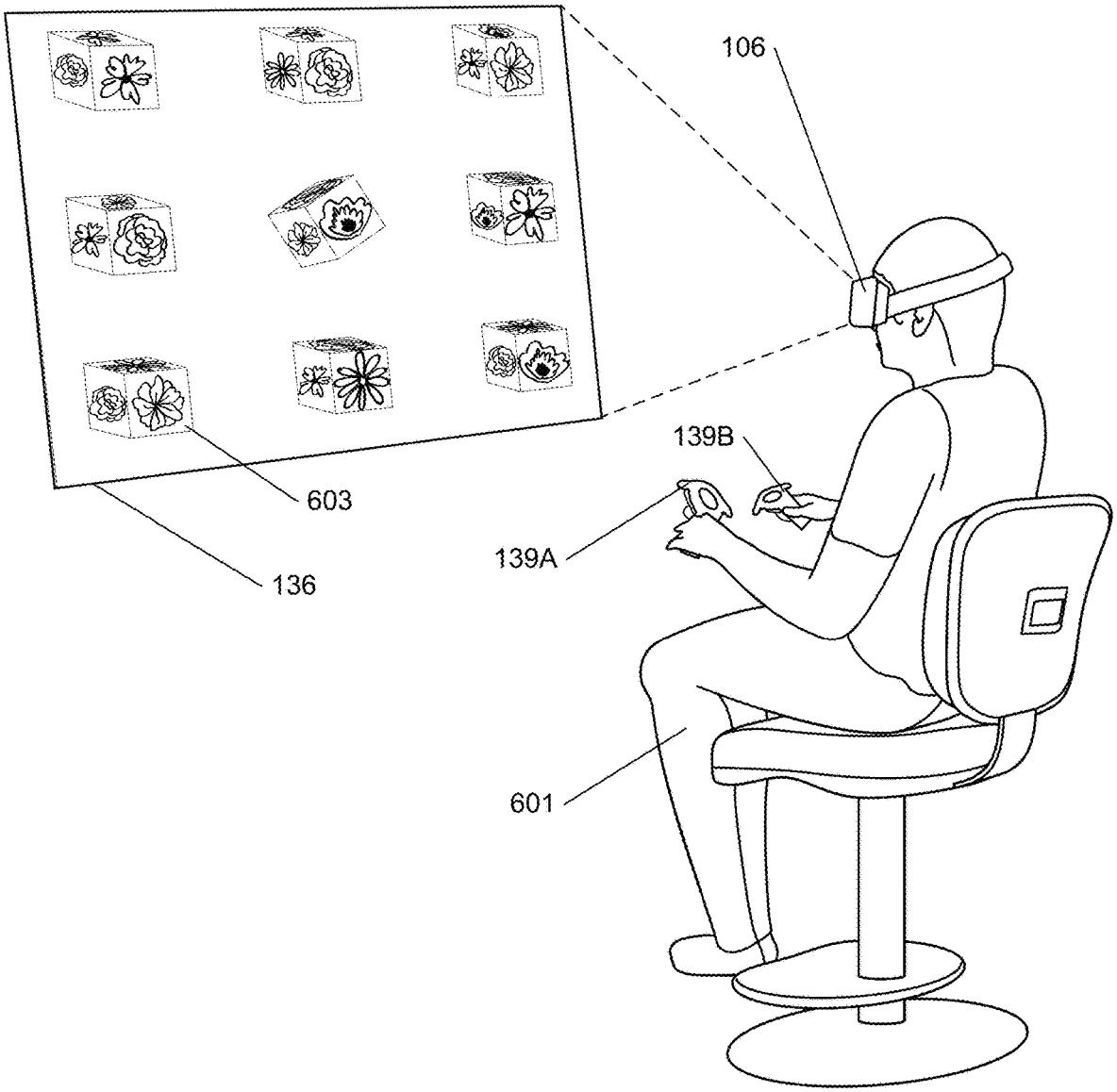
FIG. 6 shows an exemplary gaming area according to one embodiment of the present disclosure.

FIG. 6 shows an exemplary gaming area 600. The gaming device 106 can be a virtual or augmented reality device worn by a patron 601. The gaming device 106 can render a display 136 such that the information thereon appears in a virtual reality or augmented reality environment. For example, the gaming device 106 can render a display 136 within the patron's field of view such that the display appears to "float" in front of the patron 601. The gaming device 106 can include one or more input devices 139A-B that allow the patron 601 to interact with the display 136 via physical movement. For example, in response to the patron 601 swiping the input device 139A horizontally from left to right, the gaming device 106 rotates a plurality of prismatic objects 603 along a horizontal axis and at a similar speed to the swiping speed of the patron. In other example, in response to the patron 601 swiping the input device 139B vertically from top to bottom, the gaming device 106 rotates the plurality of prismatic objects along a vertical axis. The gaming device 106 can receive selection of a particular prismatic object 603 or other selectable object of the display 136 by determining a trajectory at which one or more input devices 139A-B are pointed and determining a corresponding region on the display 136 at which the trajectory of the "point" would intersect. While not shown in FIG. 6, the gaming device 106 can render one or more virtual cursors or other selectors that mirror the position and trajectory of one or more input devices 139A-B and, thereby, allow the patron 601 to input accurate and precise selections.

Figure 7:
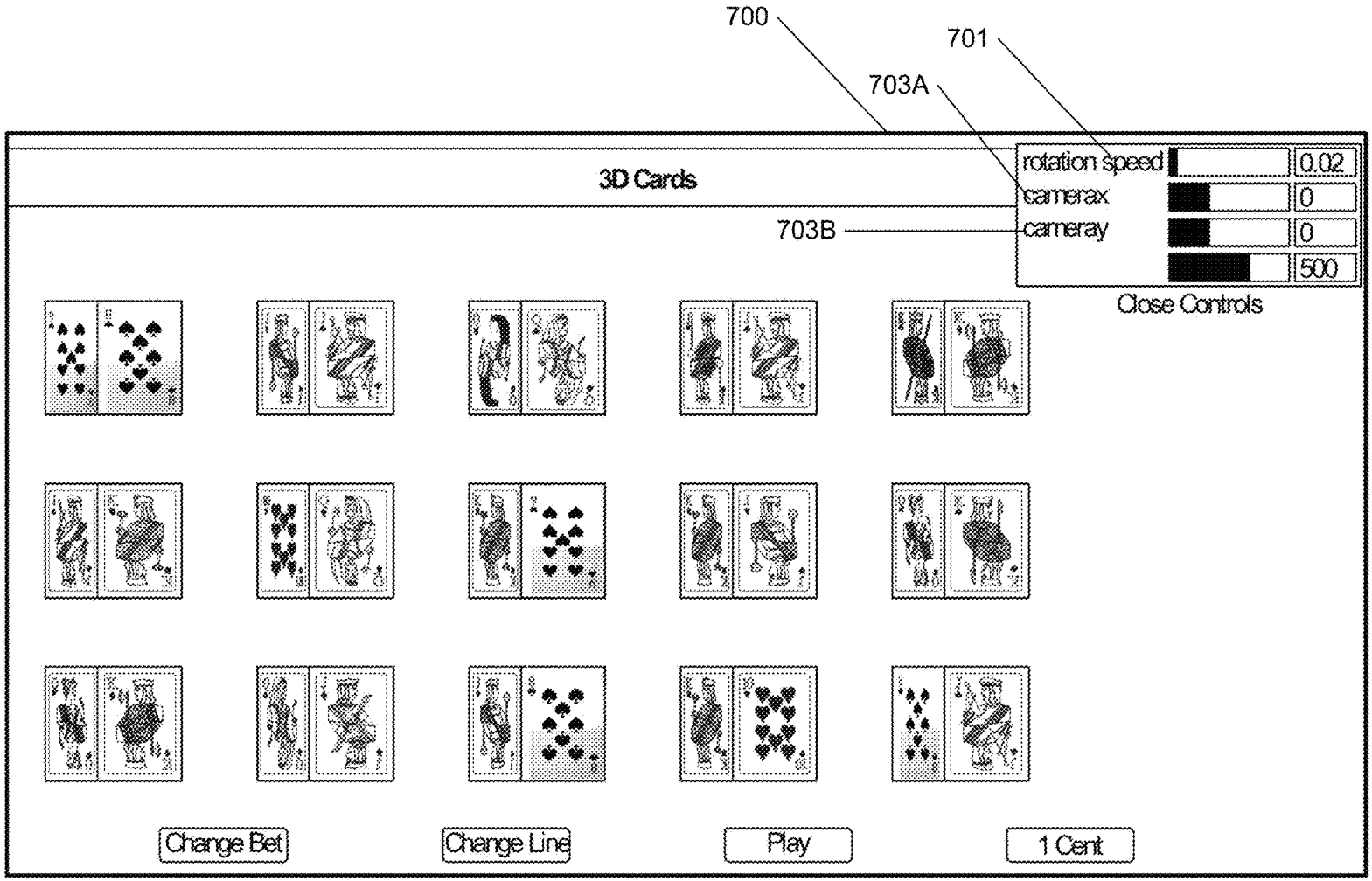
FIG. 7 shows an exemplary gaming interface according to one embodiment of the present disclosure.

FIG. 7 shows an exemplary gaming interface 700 that may be rendered by a gaming device 106 (FIG. 1). The gaming interface 700 can include a speed control 701 that may be used by a developer to control rotational speeds by which prismatic objects are rotated and that may be provided to or hidden from the patron during a wagering game (e.g., or at all times). The speed control 701 can include a slider, dial, input field, or other selectable feature that may be adjusted to increase or decrease speed. The gaming interface 700 can include camera controls 703A-B for adjusting a viewing angle from which the gaming interface 700 (e.g., or, in particular, prismatic objects shown thereon) may be observed. For example, the camera control 703A controls a viewing angle along an X-axis and the camera control 703B controls a viewing angle along a Y-axis. In this example, the gaming interface 700 can include an additional camera control for controlling a viewing angle along a Z-axis (e.g., the axes being orthogonal to each other axis).

Figure 8:
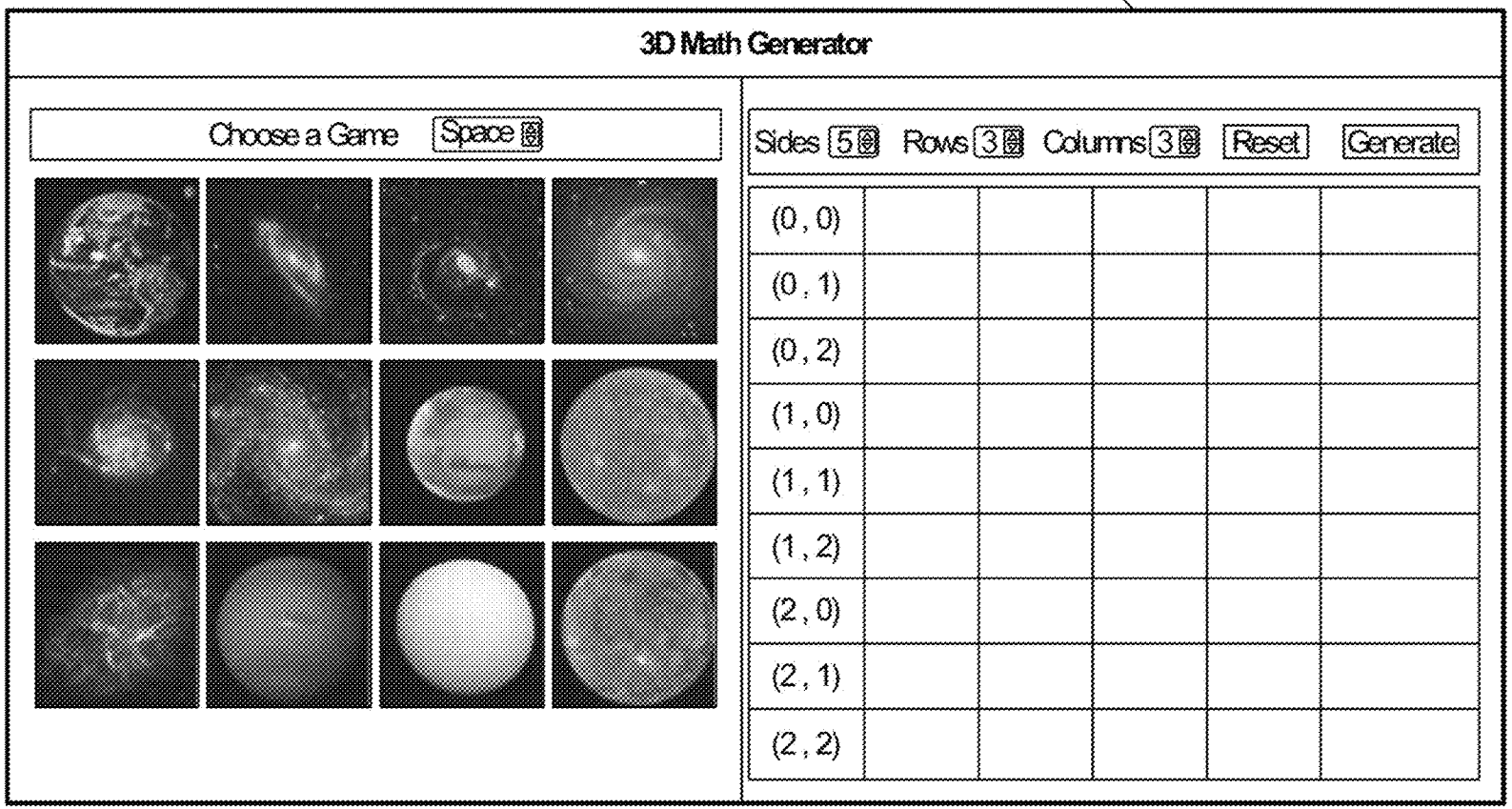
FIG. 8 shows exemplary game creation interfaces according to one embodiment of the present disclosure.
Figure 9:
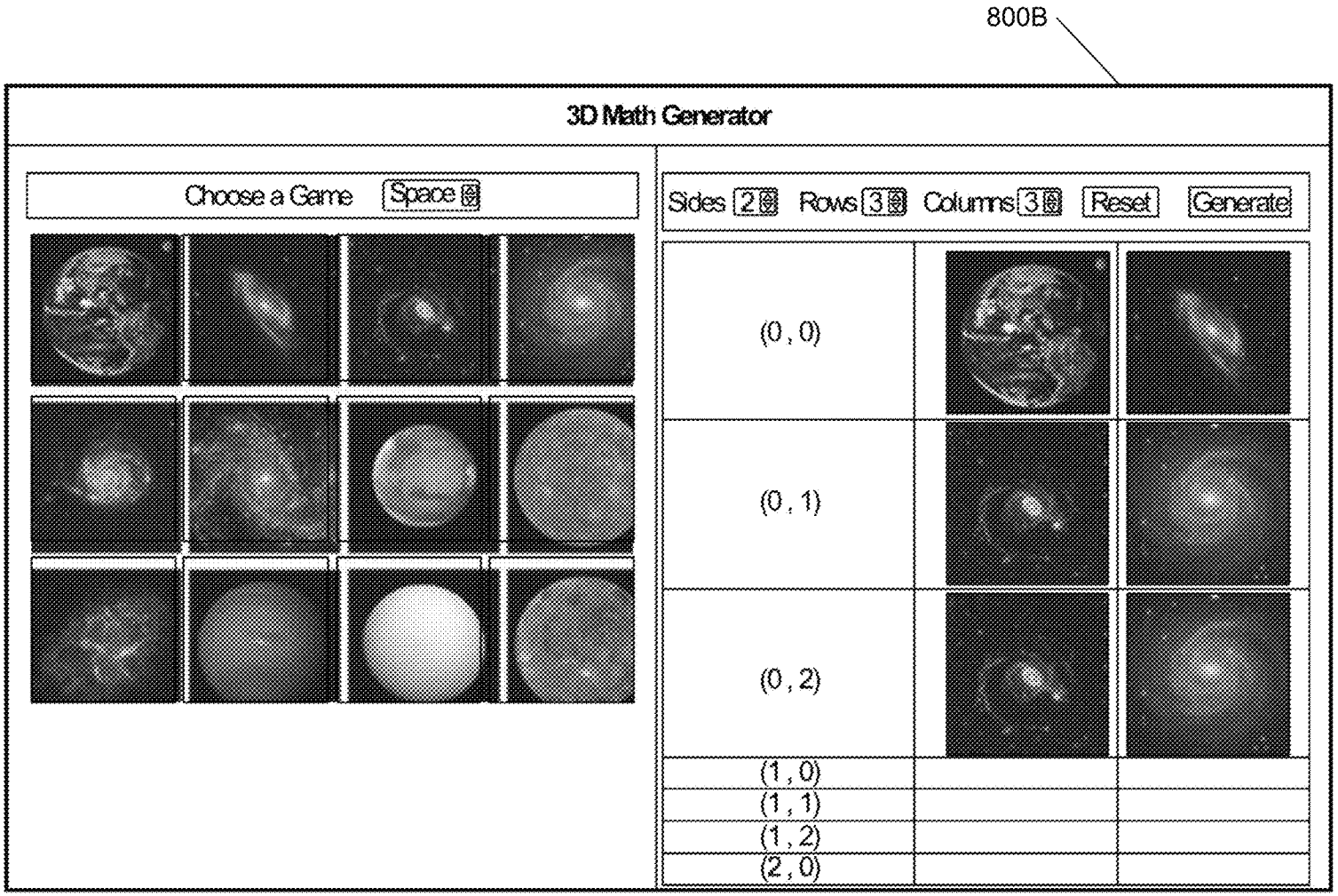
FIG. 9 show exemplary game creation interfaces according to one embodiment of the present disclosure.

FIGS. 8-9 show exemplary game creation interfaces 800A, 800B that may be used for generation and adjustment of wagering games discussed herein. For example, by the game creation interfaces 800A, 800B, the gaming device 106 (e.g., or gaming system 203) receives a number of prismatic objects to render, one or more types of prismatic objects to render, a number of sides to include in the prismatic object, and indicia to-be-rendered on the sides of the prismatic objects.

Figure 10:
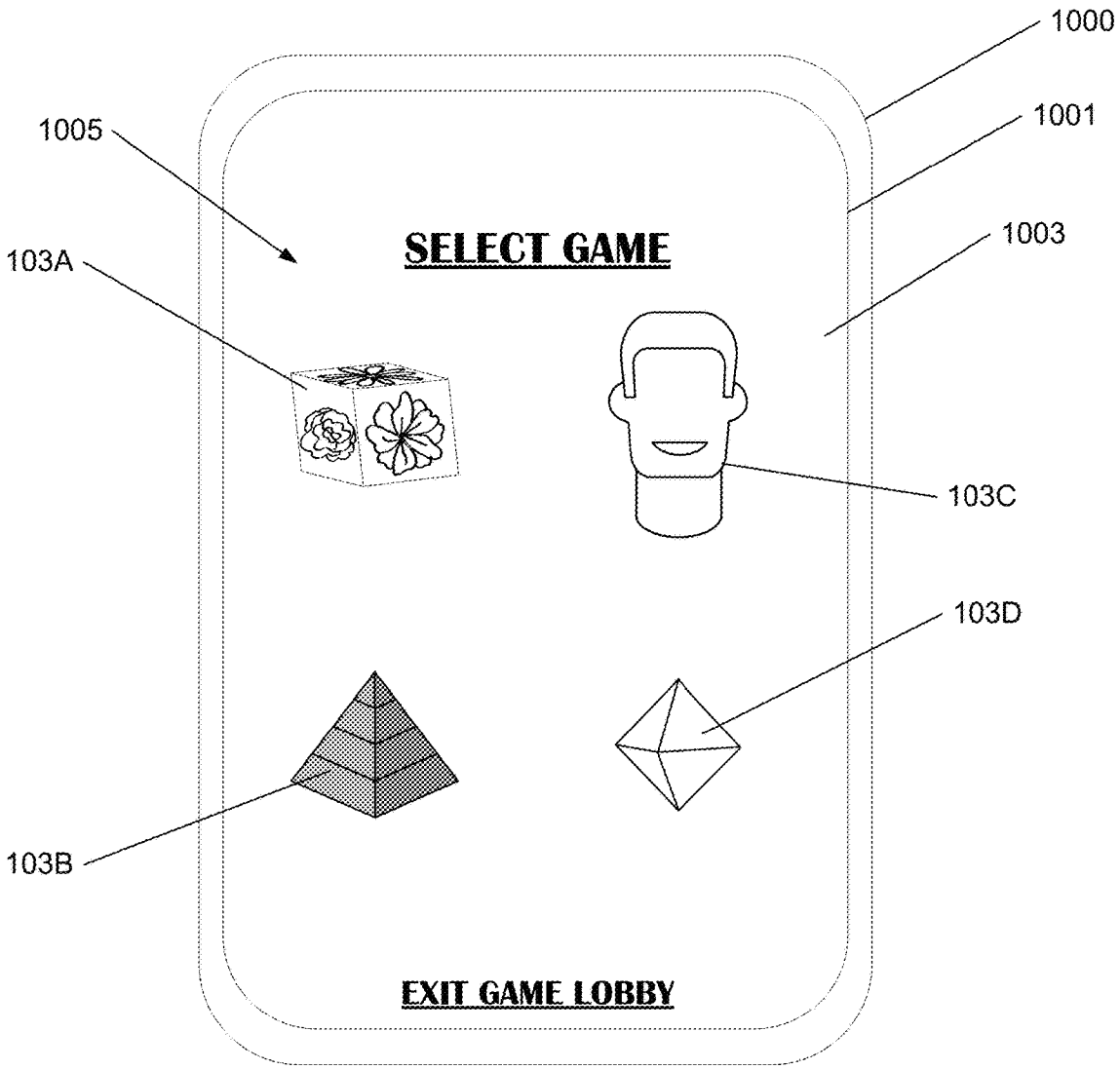
FIG. 10 shows an exemplary computing device according to one embodiment of the present disclosure.

FIG. 10 shows an exemplary computing device 1000 with a display 1001. The wagering games described herein can be executed on any suitable computing device including but not limited to smartphones, tablets, laptops, smart accessories (e.g., smart watches and other wearables), and internet-of-things (IoT) devices. The wagering games described herein can be executed in a remote environment, such as, for example, a remote server or streamed application. The wagering games described herein can be executed in a local environment, such as, for example, a web browser or a downloaded application.

The computing device 1000 can render a user interface 1003 on the display 1001. The user interface 1003 can include a virtual game lobby 1005 including a plurality of selectable fields 103A-D that are each associated with a particular wagering game and/or a particular mode thereof. The computing device 1000 can initiate a particular wagering game in response to receiving a selection input for one of the plurality of selectable fields 103A-D. In some embodiments, initiating the wagering game includes the computing device 1000 causing a web browser thereof to access a particular network address or other remote environment. In at least one embodiment, initiating the wagering game includes the computing device 1000 initiating a program or application that includes executable code for running the selected wagering game.

From the foregoing, it will be understood that various aspects of the processes described herein are software processes that execute on computer systems that form parts of the system. Accordingly, it will be understood that various embodiments of the system described herein are generally implemented as specially-configured computers including various computer hardware components and, in many cases, significant additional features as compared to conventional or known computers, processes, or the like, as discussed in greater detail herein. Embodiments within the scope of the present disclosure also include computer-readable media for carrying or having computer-executable instructions or data structures stored thereon. Such computer-readable media can be any available media which can be accessed by a computer, or downloadable through communication networks. By way of example, and not limitation, such computer-readable media can comprise various forms of data storage devices or media such as RAM, ROM, flash memory, EEPROM, CD-ROM, DVD, or other optical disk storage, magnetic disk storage, solid state drives (SSDs) or other data storage devices, any type of removable non-volatile memories such as secure digital (SD), flash memory, memory stick, etc., or any other medium which can be used to carry or store computer program code in the form of computer-executable instructions or data structures and which can be accessed by a general purpose computer, special purpose computer, specially-configured computer, mobile device, etc.

When information is transferred or provided over a network or another communications connection (either hardwired, wireless, or a combination of hardwired or wireless) to a computer, the computer properly views the connection as a computer-readable medium. Thus, any such connection is properly termed and considered a computer-readable medium. Combinations of the above should also be included within the scope of computer-readable media. Computer-executable instructions comprise, for example, instructions and data which cause a general purpose computer, special purpose computer, or special purpose processing device such as a mobile device processor to perform one specific function or a group of functions.

Those skilled in the art will understand the features and aspects of a suitable computing environment in which aspects of the disclosure may be implemented. Although not required, some of the embodiments of the claimed systems may be described in the context of computer-executable instructions, such as program modules or engines, as described earlier, being executed by computers in networked environments. Such program modules are often reflected and illustrated by flow charts, sequence diagrams, exemplary screen displays, and other techniques used by those skilled in the art to communicate how to make and use such computer program modules. Generally, program modules include routines, programs, functions, objects, components, data structures, application programming interface (API) calls to other computers whether local or remote, etc. that perform particular tasks or implement particular defined data types, within the computer. Computer-executable instructions, associated data structures and/or schemas, and program modules represent examples of the program code for executing steps of the methods disclosed herein. The particular sequence of such executable instructions or associated data structures represent examples of corresponding acts for implementing the functions described in such steps.

Those skilled in the art will also appreciate that the claimed and/or described systems and methods may be practiced in network computing environments with many types of computer system configurations, including personal computers, smartphones, tablets, hand-held devices, multiprocessor systems, microprocessor-based or programmable consumer electronics, networked PCs, minicomputers, mainframe computers, and the like. Embodiments of the claimed system are practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing various aspects of the described operations, which is not illustrated, includes a computing device including a processing unit, a system memory, and a system bus that couples various system components including the system memory to the processing unit. The computer will typically include one or more data storage devices for reading data from and writing data to. The data storage devices provide nonvolatile storage of computer-executable instructions, data structures, program modules, and other data for the computer.

Computer program code that implements the functionality described herein typically comprises one or more program modules that may be stored on a data storage device. This program code, as is known to those skilled in the art, usually includes an operating system, one or more application programs, other program modules, and program data. A user may enter commands and information into the computer through keyboard, touch screen, pointing device, a script containing computer program code written in a scripting language or other input devices (not shown), such as a microphone, etc. These and other input devices are often connected to the processing unit through known electrical, optical, or wireless connections.

The computer that effects many aspects of the described processes will typically operate in a networked environment using logical connections to one or more remote computers or data sources, which are described further below. Remote computers may be another personal computer, a server, a router, a network PC, a peer device or other common network node, and typically include many or all of the elements described above relative to the main computer system in which the systems are embodied. The logical connections between computers include a local area network (LAN), a wide area network (WAN), virtual networks (WAN or LAN), and wireless LANs (WLAN) that are presented here by way of example and not limitation. Such networking environments are commonplace in office-wide or enterprise-wide computer networks, intranets, and the Internet.

When used in a LAN or WLAN networking environment, a computer system implementing aspects of the system is connected to the local network through a network interface or adapter. When used in a WAN or WLAN networking environment, the computer may include a modem, a wireless link, or other mechanisms for establishing communications over the wide area network, such as the Internet. In a networked environment, program modules depicted relative to the computer, or portions thereof, may be stored in a remote data storage device. It will be appreciated that the network connections described or shown are exemplary and other mechanisms of establishing communications over wide area networks or the Internet may be used.

While various aspects have been described in the context of a preferred embodiment, additional aspects, features, and methodologies of the claimed systems will be readily discernible from the description herein, by those of ordinary skill in the art. Many embodiments and adaptations of the disclosure and claimed systems other than those herein described, as well as many variations, modifications, and equivalent arrangements and methodologies, will be apparent from or reasonably suggested by the disclosure and the foregoing description thereof, without departing from the substance or scope of the claims. Furthermore, any sequence (s) and/or temporal order of steps of various processes described and claimed herein are those considered to be the best mode contemplated for carrying out the claimed systems. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed systems. In addition, some steps may be carried out simultaneously, contemporaneously, or in synchronization with other steps.

Aspects, features, and benefits of the claimed devices and methods for using the same will become apparent from the information disclosed in the exhibits and the other applications as incorporated by reference. Variations and modifications to the disclosed systems and methods may be effected without departing from the spirit and scope of the novel concepts of the disclosure.

It will, nevertheless, be understood that no limitation of the scope of the disclosure is intended by the information disclosed in the exhibits or the applications incorporated by reference; any alterations and further modifications of the described or illustrated embodiments, and any further applications of the principles of the disclosure as illustrated therein are contemplated as would normally occur to one skilled in the art to which the disclosure relates.

The foregoing description of the exemplary embodiments has been presented only for the purposes of illustration and description and is not intended to be exhaustive or to limit the devices and methods for using the same to the precise forms disclosed. Many modifications and variations are possible in light of the above teaching.

The embodiments were chosen and described in order to explain the principles of the devices and methods for using the same and their practical application so as to enable others skilled in the art to utilize the devices and methods for using the same and various embodiments and with various modifications as are suited to the particular use contemplated. Alternative embodiments will become apparent to those skilled in the art to which the present devices and methods for using the same pertain without departing from their spirit and scope. Accordingly, the scope of the present devices and methods for using the same is defined by the appended claims rather than the foregoing description and the exemplary embodiments described therein.

What is claimed is:

1. A system, comprising:

a memory; and at least one computing device in communication with the memory, the at least one computing device being configured to at least:

generate a digital representation of a plurality of prismatic objects, wherein each of the plurality of prismatic objects comprises at least four sides;

determine a plurality of sets of indicia from a plurality of indicia, the plurality of sets of indicia individually corresponding to a respective one of the plurality of prismatic objects;

generate a user interface for a wagering game comprising the digital representation of the plurality of prismatic objects arranged in a grid, wherein each side of the at least four sides for each of the plurality of prismatic objects comprises a respective indicia from a corresponding one of the plurality of sets of indicia;

in response to a user input to initiate the wagering game, rotate the digital representation of each of the plurality of prismatic objects along three orthogonal axes, wherein the plurality of prismatic objects rotate along a first axis of the three orthogonal axes at a different speed from at least one other axis of the three orthogonal axes;

replace, with a different indicia from the plurality of indicia and while rotating the digital representation of each of the plurality of prismatic objects along the three orthogonal axes, a particular indicia while the particular indicia is positioned on an unobservable side of a particular prismatic object of the plurality of prismatic objects;

individually stop rotation of the digital representation of each of the plurality of prismatic objects by decreasing a rotational speed of each respective prismatic object according to a predetermined sequence with a respective randomly selected side of the at least four sides being shown on the user interface for each of the plurality of prismatic objects; and determine an outcome of the wagering game based on the respective randomly selected side of the at least four sides being shown on the user interface for each of the plurality of prismatic objects.

2. The system of claim 1, wherein the at least one computing device is further configured to:

identify one of a plurality of sequences of indicia in one of a plurality of pay lines in the grid; and generate an award to the wagering game, wherein the award corresponds to the one of the plurality of sequences of indicia.

3. The system of claim 1, wherein the at least one computing device is further configured to:

determine that the outcome of the wagering game comprises a predefined set of indicia of the plurality of indicia along a particular path in the grid; and generate a bonus game comprising a subset of the plurality of prismatic objects.

4. The system of claim 1, wherein the at least four sides of each of the plurality of prismatic objects comprises a same number of sides.

5. The system of claim 1, wherein a respective count of indicia in each of the plurality of sets of indicia equals a respective count of sides of the at least four sides for a corresponding prismatic objects of the plurality of prismatic objects.

6. The system of claim 1, wherein a count of the plurality of indicia exceeds a count of sides of the at least four sides for each of the plurality of prismatic objects.

7. The system of claim 1, wherein the at least one computing device is further configured to move the digital representation of each of the plurality of prismatic objects in at least one pattern.

8. A method, comprising:

generating, via at least one computing device, a digital representation of a plurality of prismatic objects;

assigning, via the at least one computing device, a respective indicia from a plurality of indicia to each side of each of the plurality of prismatic objects;

generating, via the at least one computing device, a user interface for a wagering game comprising the digital representation of the plurality of prismatic objects arranged in a grid;

in response to a user input to initiate the wagering game, rotating, via the at least one computing device, the digital representation of each of the plurality of prismatic objects along three orthogonal axes, wherein the plurality of prismatic objects rotate along a first axis of the three orthogonal axes at a different speed from at least one other axis of the three orthogonal axes;

replacing, with a different indicia from the plurality of indicia while rotating the digital representation of each of the plurality of prismatic objects along the three orthogonal axes and via the at least one computing device, a particular indicia while the particular indicia is positioned on an unobservable side of a particular prismatic object of the plurality of prismatic objects;

individually ceasing, via the at least one computing device, rotation of the digital representation of each of the plurality of prismatic objects by decreasing a rotational speed of each respective prismatic object according to a predetermined sequence with a respective randomly selected indicia assigned to a respective side of each of the plurality of prismatic objects being shown on the user interface; and determining, via the at least one computing device, an outcome of the wagering game based on the respective randomly selected indicia assigned to the respective side of each of the plurality of prismatic objects being shown on the user interface.

9. The method of claim 8, further comprising:

transmitting, via the at least one computing device, a wagered value associated with the wagering game to a remote server associated with a progressive jackpot;

receiving, via the at least one computing device, a pay amount of the progressive jackpot from the remote server; and determining, via the at least one computing device, that the outcome of the wagering game corresponds to a progressive award; and awarding, via the at least one computing device, the pay amount to the wagering game.

10. The method of claim 8, further comprising:

triggering, via the at least one computing device, a shuffle event; and changing, via the at least one computing device, a respective position of each prismatic object in a subset of the plurality of prismatic objects within the grid.

11. The method of claim 8, wherein the different indicia comprises a wild indicia.

12. The method of claim 8, further comprising: translating, via the at least one computing device, the digital representation of each of the plurality of prismatic objects in at least one direction.

13. A non-transitory computer-readable medium embodying a program that, when executed by at least one computing device, causes the at least one computing device to:

generate a digital representation of a plurality of prismatic objects, wherein each of the plurality of prismatic objects comprises at least four sides;

determine a plurality of sets of indicia from a plurality of indicia, the plurality of sets of indicia individually corresponding to a respective one of the plurality of prismatic objects;

generate a user interface for a wagering game comprising the digital representation of the plurality of prismatic objects arranged in a grid, wherein each side of the at least four sides for each of the plurality of prismatic objects comprises a respective indicia from a corresponding one of the plurality of sets of indicia;

rotate the digital representation of each of the plurality of prismatic objects along along three orthogonal axes, wherein the plurality of prismatic objects rotate along a first axis of the three orthogonal axes at a different speed from at least one other axis of the three orthogonal axes;

replace, with a different indicia from the plurality of indicia and while rotating the digital representation of each of the plurality of prismatic objects along the three orthogonal axes, a particular indicia while the particular indicia is positioned on an unobservable side of a particular prismatic object of the plurality of prismatic objects;

individually stop the rotation of the digital representation of each of the plurality of prismatic objects by decreasing a rotational speed of each respective prismatic object according to a predetermined sequence with a respective randomly selected side of the at least four sides being shown on the user interface for each of the plurality of prismatic objects; and determine an outcome of the wagering game based on the respective randomly selected side of the at least four sides being shown on the user interface for each of the plurality of prismatic objects.

14. The non-transitory computer-readable medium of claim 13, wherein the program further causes the at least one computing device to:

rotate a first at least one prismatic object about the first axis; and rotate a second at least one prismatic object about a second axis perpendicular to the first axis.

15. The non-transitory computer-readable medium of claim 14, wherein the program further causes the at least one computing device to rotate a third at least one prismatic object about both the first axis and the second axis.

16. The non-transitory computer-readable medium of claim 14, wherein the first at least one prismatic object and the second at least one prismatic object are mutually exclusive with each other.

17. The non-transitory computer-readable medium of claim 13, wherein the program further causes the at least one computing device to:

determine that a combination of indicia on a subset of the plurality of prismatic objects along a particular pay line omits a winnable combination; and in response to determining that the combination of indicia along the particular pay line omits the winnable combination, determine an updated plurality of sets of indicia from the plurality of indicia; and update each of the plurality of prismatic objects based on a respective one of the updated plurality of sets of indicia.

18. The non-transitory computer-readable medium of claim 13, wherein the program further causes the at least one computing device to fix a specific prismatic object from rotating for a predetermined number of wagering games.

19. The non-transitory computer-readable medium of claim 18, wherein the specific prismatic object is fixed from rotating for the predetermined number of wagering games based on the outcome of the wagering game.

20. The non-transitory computer-readable medium of claim 13, wherein a rotation speed of the each of the plurality of prismatic objects is based on a pseudorandom seed value bound to a predetermined range.

* * * * *